US009370871B2

(12) United States Patent
Hashish et al.

(10) Patent No.: US 9,370,871 B2
(45) Date of Patent: Jun. 21, 2016

(54) FLUID JET CUTTING SYSTEMS

(71) Applicant: Flow International Corporation, Kent, WA (US)

(72) Inventors: Mohamed A. Hashish, Bellevue, WA (US); Alex M. Chillman, Seattle, WA (US); Charles M. Brown, Bellevue, WA (US); Steven J. Craigen, Auburn, WA (US)

(73) Assignee: Flow International Corporation, Kent, WA (US)

( * ) Notice: Subject to any disclaimer, the term of this patent is extended or adjusted under 35 U.S.C. 154(b) by 0 days.

(21) Appl. No.: 14/742,337

(22) Filed: Jun. 17, 2015

(65) Prior Publication Data

US 2015/0283724 A1 Oct. 8, 2015

Related U.S. Application Data

(62) Division of application No. 14/065,255, filed on Oct. 28, 2013.

(51) Int. Cl.

| | |
|---|---|
| ***B26F 3/00*** | (2006.01) |
| ***B24C 3/18*** | (2006.01) |
| ***B24C 1/04*** | (2006.01) |
| ***B24C 3/06*** | (2006.01) |

(52) U.S. Cl.

CPC ..... *B26F 3/004* (2013.01); *B24C 1/045* (2013.01); *B24C 3/06* (2013.01); *B24C 3/18* (2013.01); *B26F 3/008* (2013.01)

(58) Field of Classification Search

CPC ..... B24B 55/12; B24C 1/045; B24C 3/04; B24C 3/065; B24C 3/18; B24C 3/22; B24C 9/00; B24C 9/003; B24C 9/006; B23Q 11/0046; B26F 3/008

See application file for complete search history.

(56) References Cited

U.S. PATENT DOCUMENTS

| | | | |
|---|---|---|---|
| 3,730,040 | A | 5/1973 | Chadwick et al. |
| 4,432,169 | A | 2/1984 | Schultz et al. |
| 4,435,902 | A | 3/1984 | Mercer et al. |
| 4,532,949 | A | 8/1985 | Frank |
| 4,651,476 | A | 3/1987 | Marx et al. |
| 4,665,949 | A | 5/1987 | Jordan |
| 4,669,229 | A | 6/1987 | Ehlbeck |

(Continued)

FOREIGN PATENT DOCUMENTS

| | | | |
|---|---|---|---|
| CN | 101758517 | A | 6/2010 |
| DE | 19603933 | A1 | 8/1997 |

(Continued)

*Primary Examiner* — Timothy V Eley

(74) *Attorney, Agent, or Firm* — Seed IP Law Group PLLC

(57) ABSTRACT

Fluid jet systems, components and related methods are provided which are well adapted for processing workpieces under particularly work-friendly conditions. Embodiments include fluid jet systems and related methods that reduce, minimize or eliminate a gap between a workpiece being processed and jet receiving devices that receive and dissipate the energy of a fluid jet passing through the workpiece. Other embodiments include fluid jet systems and related methods involving fluid jet processing of workpieces in a submerged condition. Still further embodiments include fluid jet systems and related methods involving position and orientation adjustment of a fluid jet receptacle to coordinate the path of an incoming fluid jet with a central axis or other feature of the fluid jet receptacle.

11 Claims, 12 Drawing Sheets

(56) References Cited

U.S. PATENT DOCUMENTS

| | | | | |
|---|---|---|---|---|
| 4,698,939 | A | 10/1987 | Hashish | |
| 4,758,284 | A | 7/1988 | Todd | |
| 4,799,415 | A | 1/1989 | Gerdes | |
| 4,827,679 | A | 5/1989 | Earle, III | |
| 4,848,042 | A | 7/1989 | Smith et al. | |
| 4,862,649 | A | 9/1989 | Davis et al. | |
| 4,864,780 | A | 9/1989 | Ehlbeck et al. | |
| 4,877,468 | A | 10/1989 | Siegenthaler | |
| 4,920,841 | A | 5/1990 | Johnson | |
| 4,937,985 | A | 7/1990 | Boers et al. | |
| 5,111,652 | A | 5/1992 | Andre | |
| 5,279,075 | A | 1/1994 | Sage et al. | |
| 5,390,128 | A | 2/1995 | Ryan et al. | |
| 5,527,204 | A * | 6/1996 | Rhoades | B24C 1/045 451/39 |
| 5,643,058 | A | 7/1997 | Erichsen et al. | |
| 5,980,372 | A | 11/1999 | Spishak | |
| 6,379,988 | B1 | 4/2002 | Peterson et al. | |
| 6,719,611 | B2 | 4/2004 | Kordonski et al. | |
| 6,766,216 | B2 | 7/2004 | Erichsen et al. | |
| 7,052,378 | B2 | 5/2006 | Tateiwa et al. | |
| 7,153,186 | B2 | 12/2006 | Popescu et al. | |
| 7,238,090 | B2 | 7/2007 | Tolles et al. | |
| 8,021,094 | B2 | 9/2011 | Mori et al. | |
| 8,132,835 | B2 | 3/2012 | Ban et al. | |
| 2005/0226711 | A1 | 10/2005 | Schnoor et al. | |
| 2007/0028735 | A1 | 2/2007 | Brodbek et al. | |
| 2009/0124178 | A1 * | 5/2009 | Ueyama | B26F 3/008 451/91 |
| 2010/0204824 | A1 | 8/2010 | Luce et al. | |
| 2012/0184185 | A1 | 7/2012 | Kanazawa et al. | |
| 2013/0025425 | A1 | 1/2013 | Knaupp et al. | |
| 2014/0024295 | A1 | 1/2014 | Hashish et al. | |
| 2014/0030963 | A1 | 1/2014 | Kanazawa et al. | |
| 2014/0109939 | A1 * | 4/2014 | David | B08B 3/02 134/36 |

FOREIGN PATENT DOCUMENTS

| | | | | |
|---|---|---|---|---|
| DE | WO 2012175407 | A1 * | 12/2012 | B08B 3/02 |
| EP | 2011609 | A2 | 1/2009 | |
| FR | 2 810 267 | A1 | 12/2001 | |
| GB | 2270290 | A | 3/1994 | |
| JP | 10123287 | A | 5/1998 | |
| JP | 10180700 | A | 7/1998 | |
| WO | 2011/086185 | A1 | 7/2011 | |

* cited by examiner

FLUID JET CUTTING SYSTEMS

BACKGROUND

1. Technical Field

This disclosure is related to fluid jet cutting systems, components and methods, and, in particular, fluid jet cutting systems, devices and methods that facilitate improved work environments.

2. Description of the Related Art

Fluid jet or abrasive-fluid jet cutting systems are used for cutting a wide variety of materials, including stone, glass, ceramics, composites and metals. In a typical fluid jet cutting system, a high-pressure fluid (e.g., water) flows through a cutting head having a cutting nozzle that directs a cutting jet onto a workpiece. The system may draw or feed abrasives into the high-pressure fluid jet to form an abrasive-fluid jet. The cutting nozzle may be controllably moved across the workpiece to cut the workpiece as desired. After the fluid jet, or abrasive fluid jet, generically referred to hereinafter as a "fluid jet," passes through the workpiece, the energy of the fluid jet is often dissipated by a relatively large volume of water in a catcher tank that may also be configured to support the workpiece. Systems for generating high-pressure fluid jets are currently available, such as, for example, the Mach 4™ five-axis waterjet system manufactured by Flow International Corporation, the assignee of the present application. Other examples of waterjet cutting systems are shown and described in Flow's U.S. Pat. No. 5,643,058, which is incorporated herein by reference in its entirety. Examples of catcher tank systems for supporting workpieces and dissipating energy of a waterjet after it passes through a workpiece are shown and described in Flow's U.S. patent application Ser. No. 13/193,435, filed Jul. 28, 2011, which is incorporated herein by reference in its entirety.

Although many fluid jet cutting systems feature a catcher tank arrangement having a relatively large volume of water contained therein to dissipate energy of the fluid jet during use, other known systems utilize compact or relatively compact fluid jet receptacles which are positioned opposite a cutting head and moved in unison with the same to catch the jet after it is discharged from the cutting head and acts on a workpiece. Examples of such receptacles (also referred to as catcher cups) and other related devices are shown and described in U.S. Pat. Nos. 4,435,902; 4,532,949; 4,651,476; 4,665,949; 4,669,229; 4,698,939; 4,799,415; 4,920,841; and 4,937,985.

Known fluid jet systems, however, can suffer from several drawbacks. For example, many fluid jet systems may be configured such that they generate excessive noise and/or other conditions that provide less than an ideal work environment.

BRIEF SUMMARY

Embodiments described herein provide fluid jet systems, components and related methods for processing workpieces under particularly work-friendly conditions. The systems, components and methods may result in, for example, reduced noise pollution and/or the elimination or reduction of other potentially disruptive work conditions, such as fluid splash back. Embodiments include fluid jet systems and related methods that reduce, minimize or eliminate a gap between a workpiece being processed and jet receiving devices that receive and dissipate the energy of a fluid jet passing through the workpiece. Other embodiments include fluid jet systems and related methods involving fluid jet processing of workpieces in a submerged condition. Still further embodiments include fluid jet systems and related methods involving position and orientation adjustment of a fluid jet receptacle to coordinate the path of an incoming fluid jet with a central axis or other feature of the fluid jet receptacle.

According to one embodiment, a fluid jet cutting system may be summarized as including a multiaxial industrial robot having an end effector to grip a workpiece to be processed, the multiaxial industrial robot configured to selectively move the workpiece within a working envelope defined by a range of motion of the multiaxial industrial robot; a tank positioned within the working envelope of the multiaxial industrial robot to enable the workpiece to be submerged under fluid within the tank during a workpiece processing operation; and at least one fluid jet cutting head having an orifice to generate a high pressure fluid jet and a fluid jet outlet from which to discharge the high pressure fluid jet, the cutting head being located relative to the tank such that, during the workpiece processing operation, the high pressure fluid jet discharges from the fluid jet outlet beneath an upper surface of the fluid within the tank, cuts through the workpiece, and dissipates within a region of the fluid in the tank located adjacent a side of the workpiece opposite the cutting head.

The at least one fluid jet cutting head may include a central axis along which the fluid jet is discharged, and wherein the central axis of the at least one fluid jet cutting head may be aligned vertically and oriented such that the fluid jet is discharged downward from fluid jet outlet during the workpiece processing operation. The at least one fluid jet cutting head may include a central axis along which the fluid jet is discharged, and wherein the central axis of the at least one fluid jet cutting head may be inclined relative to a direction normal to the upper surface of the fluid within the tank. The system may include a first fluid jet cutting head and a second fluid jet cutting head each having a central axis, the central axis of the first fluid jet cutting head aligned perpendicularly with respect to the central axis of the second fluid jet cutting head. The at least one fluid jet cutting head may be suspended with a portion thereof located above an open end of the tank. The at least one fluid jet cutting head may be spaced away from sidewalls of the tank to permit the multiaxial industrial robot to maneuver the workpiece beneath the discharged fluid jet without obstruction from the tank. The at least one fluid jet cutting head may be attached to a sidewall of the tank and extend through the sidewall of the tank. The at least one fluid jet cutting head may be movably attached to the sidewall of the tank to enable angular adjustment of the fluid jet cutting head relative to the tank. The fluid jet cutting system may further include a vacuum source, the vacuum source being coupled to the fluid jet cutting head to provide vacuum-assisted entrainment of abrasives into the high pressure fluid jet and being coupled to the tank to assist in withdrawing fluids therefrom. The fluid jet cutting system may further include an inspection station located outside of the tank within the working envelope defined by the range of motion of the multiaxial industrial robot to enable inspection of the workpiece prior to or after submersion in the tank. The fluid jet cutting system may further include a re-gripping station located outside of the tank within the working envelope defined by the range of motion of the multiaxial industrial robot to enable the multiaxial industrial robot to set a workpiece down and re-grip or re-engage the workpiece at a different location. In this manner, the workpiece may be manipulated beneath a waterjet by the multiaxial industrial robot from one of several different gripping locations.

According to another embodiment, a fluid jet cutting system may be summarized as including a fluid jet cutting head having an orifice to generate a high pressure fluid jet and a fluid jet outlet from which to discharge the high pressure fluid jet; a jet receiving receptacle to receive the high pressure fluid jet after the high pressure fluid jet passes through the workpiece during a workpiece processing operation; and a support structure to support the jet receiving receptacle, the support structure including a drive system to selectively adjust at least one of a lateral position of the jet receiving receptacle and an angular orientation of the jet receiving receptacle relative to an axis defined by the fluid jet outlet of the fluid jet cutting head.

The fluid jet cutting system may further include a motion system coupled to the fluid jet cutting head to controllably manipulate the fluid jet cutting head in space. The support structure may couple the jet receiving receptacle to the fluid jet cutting head and may position the jet receiving receptacle opposite the fluid jet outlet of the cutting head to receive the high pressure fluid jet during the workpiece processing operation. The drive system may be controllable to align a central axis of the fluid jet receptacle to be generally parallel to the high pressure fluid jet in a deflected state during the workpiece processing operation. The drive system may be controllable to adjust the fluid jet receptacle laterally to align a central axis of the fluid jet receptacle to intersect with the high pressure fluid jet in a deflected state within an inlet portion of the fluid jet receptacle during the workpiece processing operation. The support structure may include a vertical adjustment mechanism for selectively adjusting a position of the jet receiving receptacle in an axial direction parallel to the axis defined by the fluid jet outlet of the fluid jet cutting head. The fluid jet receptacle may be adjustably supported by the support structure to enable selective adjustment of the lateral position of the support structure in the direction aligned with the cutting direction of the fluid jet cutting head and selective adjustment of the angular orientation of the jet receiving receptacle relative to the axis defined by the fluid jet outlet of the fluid jet cutting head. The fluid jet receptacle may be adjustably supported by the support structure and, during at least a portion of the workpiece processing operation, a position and/or an orientation of the fluid jet receptacle may be based at least in part on process model calculations. The fluid jet receptacle may include an elongated tubular structure having a jet receiving inlet at a distal end thereof. The elongated tubular structure may have an external surface that tapers toward the distal end to provide workpiece clearance in a region immediately adjacent to and downstream of the jet receiving inlet. The elongated tubular structure may include a distal portion that is generally cylindrical. In some instances, the distal portion may have a diameter equal to or less than 1.5 inches.

According to another embodiment, a fluid jet cutting system may be summarized as including a multiaxial industrial robot having an end effector to grip a workpiece to be processed, the multiaxial industrial robot configured to selectively move the workpiece within a working envelope defined by a range of motion of the multiaxial industrial robot; a fluid jet receptacle located within the working envelope of the multiaxial industrial robot to enable the workpiece to be positioned above an inlet of the fluid jet receptacle; and a fluid jet cutting head having an orifice to generate a high pressure fluid jet and a fluid jet outlet from which to discharge the high pressure fluid jet, and wherein at least one of the fluid jet receptacle and the fluid jet cutting head is adjustable vertically to selectively adjust a clearance gap between the fluid jet outlet of the fluid jet cutting head and the inlet of the fluid jet receptacle.

The fluid jet cutting head may be fixed in space and the fluid jet receptacle may be adjustable vertically relative to the fluid jet cutting head. The fluid jet receptacle may be fixed in space and the fluid jet cutting head may be adjustable vertically and or angularly relative to the fluid jet receptacle. The fluid jet cutting system may further include a controller, the controller being configured to adjust the clearance gap between the fluid jet outlet of the fluid jet cutting head and the inlet of the fluid jet receptacle as the workpiece is manipulated beneath the high pressure fluid jet during a workpiece processing operation. The controller may be configured to adjust the clearance gap based at least in part on a model or model calculations. The fluid jet cutting system may further include one or more sensors coupled to the controller which are configured to sense a magnitude of the clearance gap, and the controller may be configured to adjust the clearance gap based at least in part on the sensed magnitude.

The fluid jet cutting system may further include a tank positioned within the working envelope of the multiaxial industrial robot to enable the workpiece to be submerged under fluid within the tank during a workpiece processing operation. The fluid jet cutting head and multiaxial industrial robot may be selectively operable with the fluid jet receptacle and the tank in an alternative manner. The fluid jet receptacle may be configured to move between an active configuration in which the fluid jet receptacle is positioned opposite the fluid jet cutting head and an inactive configuration in which the fluid jet receptacle is located away from an open end of the tank to provide access to the tank. The fluid jet cutting head may be configured to move between a first cutting configuration in which the fluid jet cutting head is positioned to discharge the high pressure fluid jet into the jet receiving receptacle and a second cutting configuration in which the fluid jet cutting head is positioned to discharge the high pressure fluid jet into the tank. The fluid jet cutting system may further include a conduit connecting the jet receiving receptacle to the tank to route contents of the high pressure fluid jet received by the jet receiving receptacle to the tank for subsequent disposal or reconditioning. The outlet of the fluid jet receptacle may be in fluid communication with the tank and submerged under water to assist in dampening noise otherwise generated during withdrawal of the contents of the high pressure fluid jet that are received by the jet receiving receptacle during operation. The fluid jet receptacle may be attached to a vacuum source or a pump to move fluid jet contents captured by the fluid jet receptacle during operation to a waste handling unit.

According to another embodiment, a jet receiving receptacle of a high pressure fluid jet system for receiving a fluid jet discharged from a fluid jet outlet of a cutting head during a workpiece processing operation may be summarized as including an inlet feed component having an inlet to receive contents of the fluid jet during the workpiece processing operation; and a noise suppression member coupled to the inlet feed component, the noise suppression member deformable between a neutral configuration and a compressed configuration in which the noise suppression member fills a gap between the inlet of the inlet feed component and the workpiece to be processed.

The noise suppression member may slidably engage the inlet feed component. The noise suppression member may be biased in an upstream direction. The jet receiving receptacle may further include a spring positioned to bias the noise suppression member in the upstream direction. The jet receiving receptacle may further include a pneumatic chamber for biasing the noise suppression member in the upstream direction. The noise suppression member may comprise a sleeve made of an elastic porous material.

DETAILED DESCRIPTION

Figure 1:
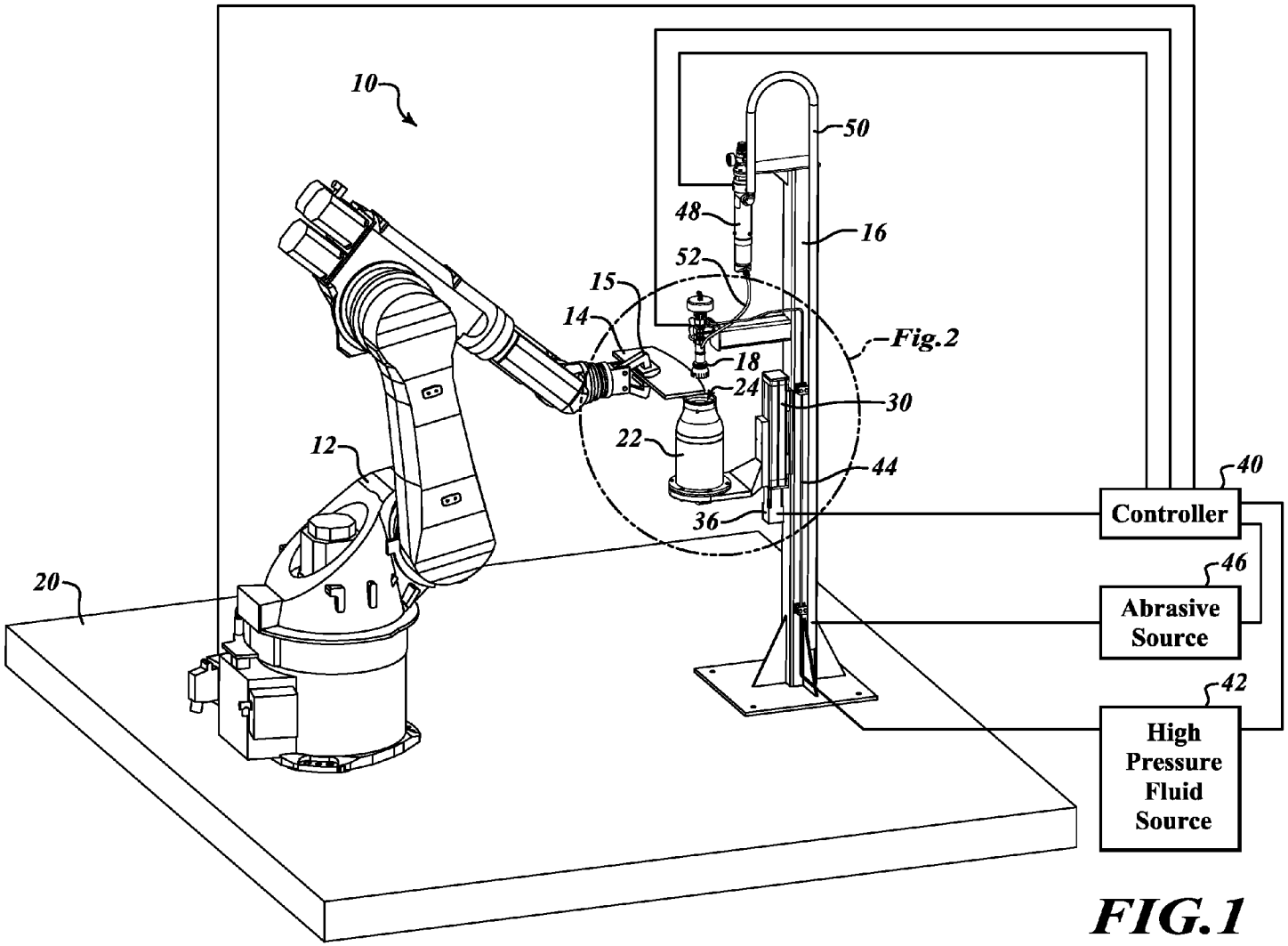
FIG. 1 is a perspective view of a fluid jet cutting system, according to one embodiment, including a multi-axis robotic motion system for manipulating a workpiece opposite a fluid jet.

In the following description, certain specific details are set forth in order to provide a thorough understanding of various disclosed embodiments. However, one of ordinary skill in the relevant art will recognize that embodiments may be practiced without one or more of these specific details. In other instances, well-known structures associated with fluid jet cutting systems and methods of operating the same may not be shown or described in detail to avoid unnecessarily obscuring descriptions of the embodiments. For instance, it will be appreciated by those of ordinary skill in the relevant art that a high-pressure fluid source and an abrasive source may be provided to feed high-pressure fluid and abrasives, respectively, to a cutting head of the fluid jet systems described herein to facilitate, for example, high-pressure or ultrahigh-pressure abrasive waterjet cutting of workpieces. As another example, well know control systems and drive components may be integrated into the fluid jet cutting systems to facilitate movement of the cutting head relative to the workpiece to be processed or vice versa. These systems may include drive components to manipulate the cutting head about various rotational and translational axes, such as, for example, as is common in five-axis abrasive waterjet cutting systems. Example fluid jet systems may include fluid jet cutting heads coupled to a gantry-type motion system or a robotic arm motion system.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide fluid jet systems and related methods for processing workpieces in particularly environmentally friendly ways, which can result in reduced noise pollution and/or the elimination or reduction of other potentially disruptive work conditions, such as fluid splash back. Embodiments include fluid jet systems and related methods that reduce, minimize or eliminate a gap between a workpiece being processed and jet receiving devices that receive and dissipate the energy of a fluid jet passing through the workpiece. Other embodiments include fluid jet systems and related methods involving fluid jet cutting of workpieces in a submerged condition. Still further embodiments include fluid jet systems and related methods involving position and orientation adjustment of a fluid jet receptacle to coordinate the path of an incoming fluid jet with a central axis or other feature of the fluid jet receptacle.

As described herein, the term cutting head may refer generally to an assembly of components at a working end of the fluid jet cutting machine or system, and may include, for example, a nozzle of the fluid jet cutting system containing an outlet aperture for discharging a high-pressure fluid jet and surrounding structures and devices coupled directly or indirectly thereto to move in unison therewith.

Figure 2:
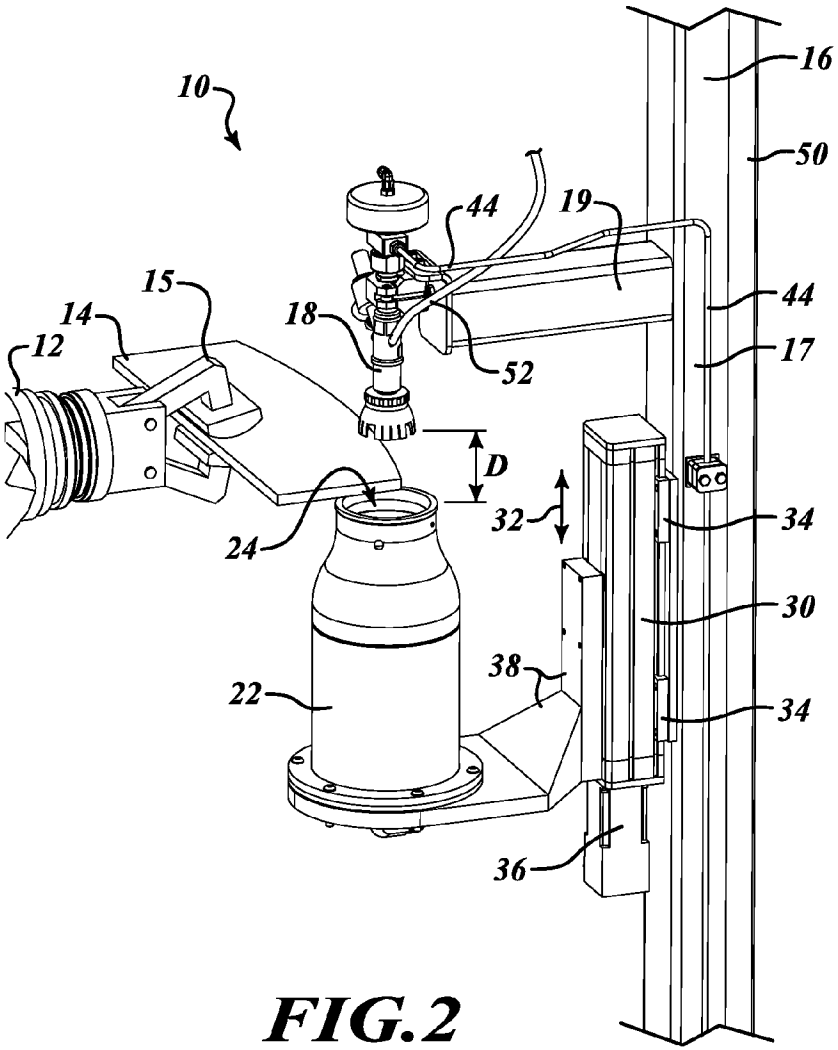
FIG. 2 is an enlarged detail view of a portion of the fluid jet cutting system of FIG. 1 illustrating vertical adjustability of a jet receiving receptacle relative to a stationary cutting head.
Figure 4:
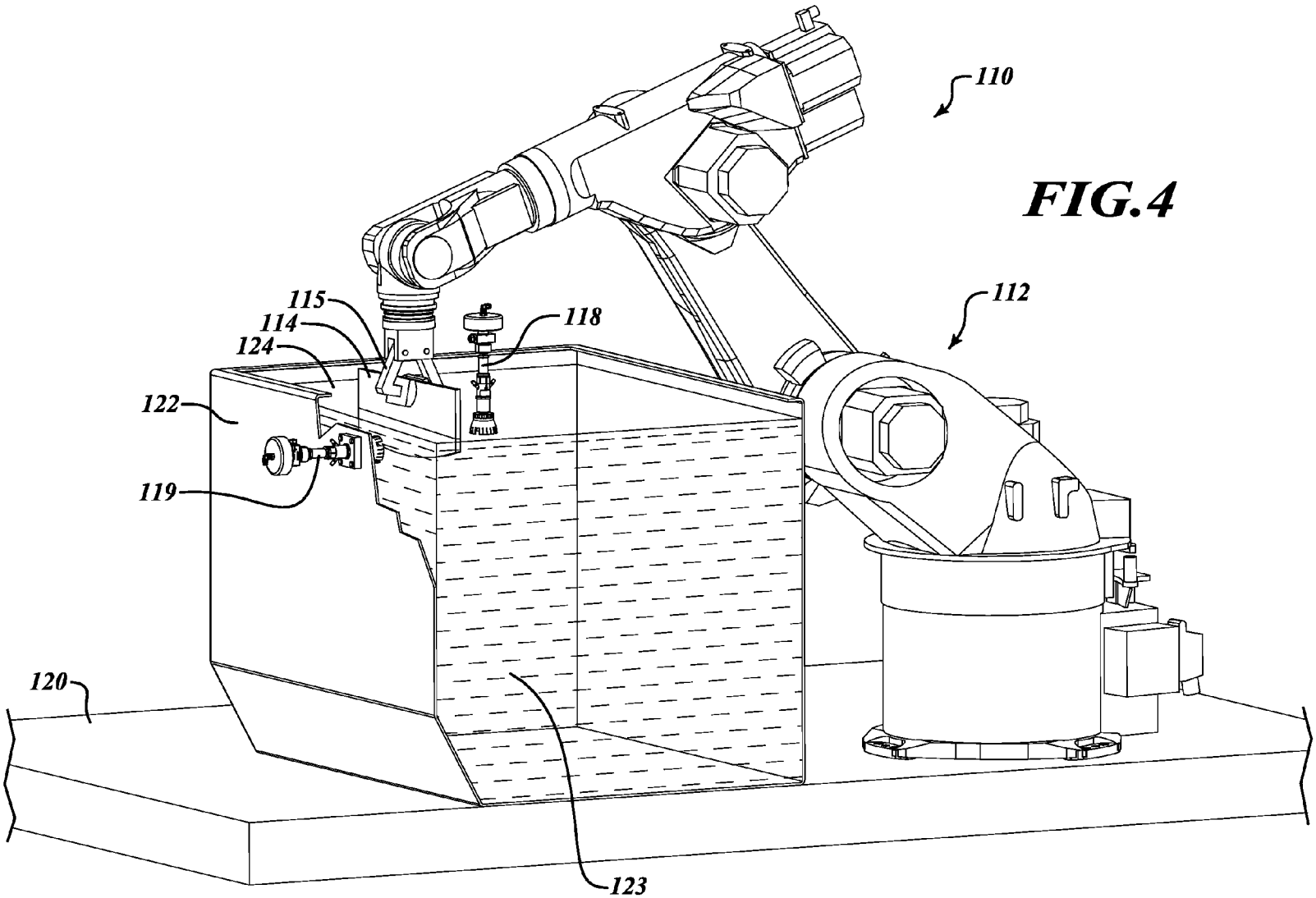
FIG. 4 is a perspective view of a fluid jet cutting system, according to another embodiment, including a multi-axis robotic motion system for manipulating a workpiece opposite a fluid jet.

FIGS. 1 and 2 show an example embodiment of a fluid jet cutting system 10. The fluid jet cutting system 10 includes a multi-axis robotic motion system 12, such as an industrial multiaxial robotic arm, which is configured to manipulate a workpiece 14 within a working envelope of the motion system 12 defined by its range of motion to be processed by a high pressure fluid jet (e.g., waterjet or abrasive waterjet). The robotic motion system 12 may include an end effector 15, such as a gripper, at the working end thereof for selectively gripping the workpiece 14 for manipulation opposite the fluid jet.

With reference to FIG. 1, a support structure 16 may be provided in the vicinity of the robotic motion system 12 to support a fluid jet cutting head 18 within or adjacent the working envelope of the robotic motion system 12. The fluid jet cutting head 18 is configured to generate a high pressure fluid jet via an orifice and to selectively discharge the fluid jet (with or without abrasives) via a fluid jet outlet for processing the workpiece 14. The support structure 16 may be a rigid structure or an adjustable structure suitable for supporting the cutting head 18 within or adjacent the working envelope of the robotic motion system 12 to enable the workpiece 14 to be positioned generally opposite the cutting head 18 to be cut, trimmed or otherwise processed by the selectively dischargeable fluid jet. The robotic motion system 12 and support structure 16 may be fixed to a common foundation 20 and/or may be located within an enclosed or partially enclosed work cell.

The support structure 16 or another distinct support structure may support a jet receiving receptacle 22 generally opposite the cutting head 18. The jet receiving receptacle 22 may include a jet inlet aperture 24 at a distal end thereof to enable the fluid jet to pass into an internal cavity of the jet receiving receptacle 22. The jet receiving receptacle 22 may include one or more energy dissipating devices within its internal cavity for dissipating energy of the incoming fluid jet. For example, the receptacle 22 may be filled with an arresting fluid and/or a plurality of ball bearings or other elements that are configured to move or rotate in response to the impinging fluid jet. Further details of such energy dissipating devices are not provided to avoid unnecessarily obscuring descriptions of the embodiments.

As shown in FIG. 2, the jet receiving receptacle 22 may be coupled to the support structure 16 or other foundational structure in a manner that enables a clearance gap distance D between the cutting head 18 and the inlet aperture 24 of the jet receiving receptacle to be adjusted. For example, in some embodiments, a linear positioner 30 may be provided intermediately between the support structure 16 and the jet receiving receptacle 22 to enable the jet receiving receptacle 22 to be controllably moved toward and away from the cutting head 18, as represented by the arrows labeled 32. Example linear positioners 30 include HD Series linear positioners available from the Electromechanical Automation Division of Parker Hannifin Corporation located in Irwin, Pa. The linear positioner 30 may be coupled to an upstanding support member 17 of the support structure 16 with toe clamps 34 or other fastening devices. The jet receiving receptacle 22 may be coupled to the linear positioner 30 by a support arm 38 or other structural member. The jet receiving receptacle 22 may be offset from the upstanding structural member 17 and oriented generally parallel thereto.

The linear positioner 30 may include a motor 36 in communication with a controller 40 (FIG. 1) to enable controlled movement of the linear positioner 30 and adjustment of the clearance gap distance D before, during and/or after workpiece processing operations. In this manner, the inlet aperture 24 of the jet receiving receptacle 22 can be maintained in close proximity to a discharge side of the workpiece 14, which may advantageously assist in reducing the level of noise otherwise generated by systems lacking such features. The clearance gap distance D may be adjusted to accommodate for workpieces 14 of different thicknesses or of varying thicknesses. In some embodiments, the clearance gap distance D may be adjusted during processing of a workpiece 14 (or a portion thereof) to reduce or minimize a gap between a rear discharge surface of the workpiece 14 and the inlet aperture 24 of the jet receiving receptacle 22.

Figure 3:
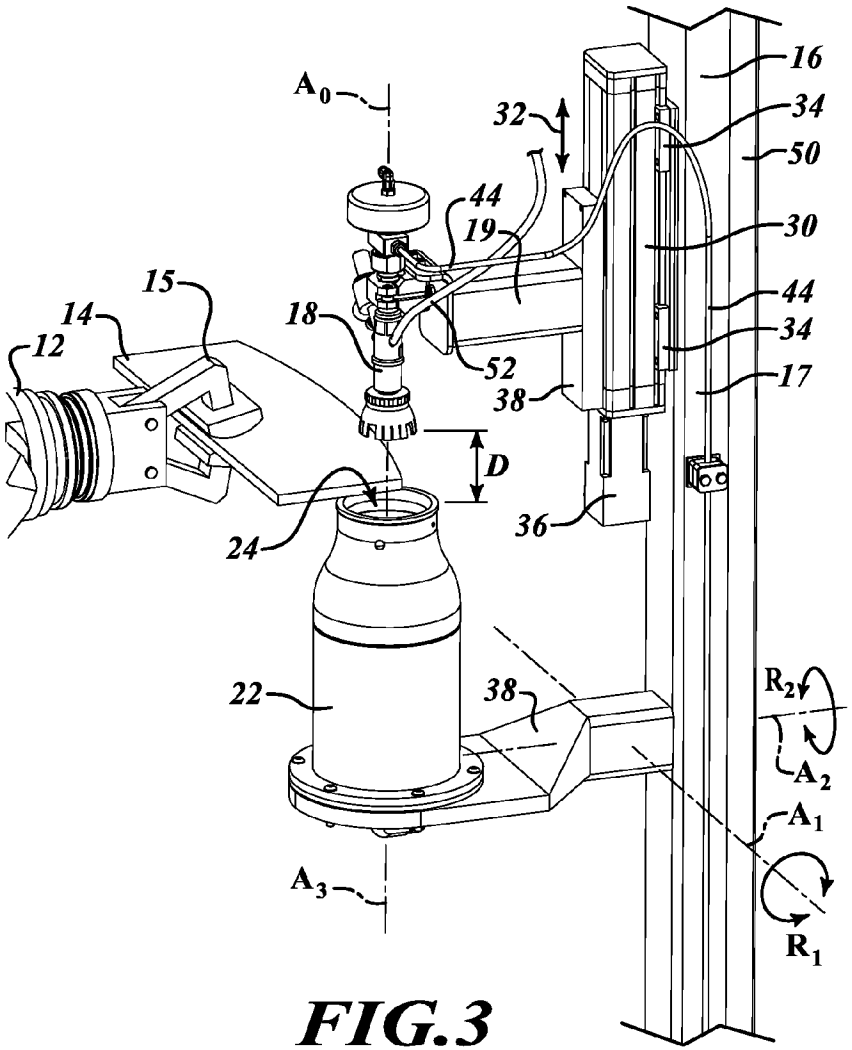
FIG. 3 is an enlarged detail view of a fluid jet cutting system, according to another embodiment, illustrating vertical adjustability of a cutting head relative to a stationary jet receiving receptacle.

With reference to FIG. 3, a variation of the aforementioned fluid jet system 10 is provided in which the jet receiving receptacle 22 is fixed relative to the support structure 16 and wherein the linear positioner 30 is provided intermediately between the support structure 16 and the cutting head 18 to enable the cutting head 18 to be controllably moved toward and away from the jet receiving receptacle, as represented by the arrows labeled 32. Again, the linear positioner 30 may be coupled to the upstanding support member 17 of the support structure 16 with toe clamps 34 or other fastening devices. The cutting head 18 may be coupled to the linear positioner 30 by a support arm 19 or other structural member. The cutting head 18 may be offset from the upstanding structural member 17 and oriented generally parallel thereto.

In some embodiments, the cutting head 18 may be aligned at an angle or may be adjustably coupled to the support structure 16 to enable adjustment of a fluid jet discharge direction of the cutting head 18 before, during and/or after processing the workpiece. Still further, in some embodiments, the jet receiving receptacle 22 may rotatable about one or more orthogonally aligned axis of rotation $A_1$, $A_2$ to enable tilting of the jet receiving receptacle 22, as indicated by the arrows labeled $R_1$, $R_2$. In some instances, the receptacle 22 may be configured to tilt before or during a processing operation (or at least during a portion of the processing operation) such that a central axis $A_3$ thereof is more closely aligned with a direction of the incoming fluid jet during operation, which may be deflected from a central axis $A_0$ of the cutting head 18 as a result of interaction with the workpiece 14.

With reference to FIG. 1, other systems or subsystems associated with fluid jet cutting systems may also be provided such as, for example, a high-pressure or ultrahigh-pressure fluid source 42 (e.g., direct drive and intensifier pumps with pressure ratings ranging from 40,000 psi to 100,000 psi and higher) for supplying high pressure or ultrahigh pressure fluid to the cutting head 18 via one or more fluid supply conduits 44 and/or an abrasive source 46 (e.g., abrasive hopper and distribution system) for feeding abrasives to the cutting head 18 to enable abrasive fluid jet cutting. More particularly, the abrasive source 46 may supply abrasives (e.g., garnet particles) to an abrasive feed system 48 via one or more abrasive supply conduits 50. The abrasive feed system 48 may be provided in close proximity to the cutting head 18 and positioned above the cutting head 18 to selectively feed abrasives to the cutting head 18 via one or more abrasive feed conduits 52. The high pressure fluid source 42, abrasive source 46, abrasive feed system 48, the cutting head 18, the multi-axis robotic motion system 12 and/or other functional components of the fluid jet system 10 may be coupled to the controller 40 to enable coordinated operation of the same. For example, the movement of the multi-axis robotic motion system 12 may be coordinated with adjusting movements of the clearance gap distance D (FIG. 2) as a workpiece 14 is manipulated opposite an abrasive fluid jet discharged from the cutting head 18. In some instances, the controller 40 may be configured to adjust the clearance gap distance D based at least in part on a model or model calculations. In other instances, the system may further include one or more sensors (not shown) coupled to the controller 40 which are configured to sense a magnitude of the clearance gap distance D, and the controller 40 may be configured to adjust the clearance gap distance D based at least in part on the sensed magnitude.

The controller 40 may generally include, without limitation, one or more computing devices, such as processors, microprocessors, digital signal processors (DSP), application-specific integrated circuits (ASIC), and the like. To store information, the controller 40 may also include one or more storage devices, such as volatile memory, non-volatile memory, read-only memory (ROM), random access memory (RAM), and the like. The storage devices can be coupled to the computing devices by one or more buses. The controller 40 may further include one or more input devices (e.g., displays, keyboards, touchpads, controller modules, or any other peripheral devices for user input) and output devices (e.g., displays screens, light indicators, and the like). The controller 40 can store one or more programs for processing any number of different workpieces according to various cutting head movement instructions. The controller 40 may also control operation of other components, such as, for example, the high pressure fluid source 42, the abrasive source 46 and the motion system 12. The controller 40, according to one embodiment, may be provided in the form of a general purpose computer system. The computer system may include components such as a CPU, various I/O components, storage, and memory. The I/O components may include a display, a network connection, a computer-readable media drive, and other I/O devices (a keyboard, a mouse, speakers, etc.). A control system manager program may be executing in memory, such as under control of the CPU, and may include functionality related to routing high-pressure fluid (e.g., water) and abrasive media through the fluid jet systems described herein.

Further example control methods and systems for fluid jet systems, such as, for example, abrasive waterjet systems that include CNC functionality, and which are applicable to the fluid jet systems described herein, are described in Flow's U.S. Pat. No. 6,766,216, which is incorporated herein by reference in its entirety. In general, computer-aided manufacturing (CAM) processes may be used to efficiently drive or control a cutting head along a designated path, such as by enabling two-dimensional or three-dimensional models of workpieces generated using computer-aided design (i.e., CAD models) to be used to generate code to drive the machines. For example, in some instances, a CAD model may be used to generate instructions to drive the appropriate controls and motors of the fluid jet systems described herein to manipulate a cutting head about various translational and/or rotational axes to cut or process a workpiece as reflected in the CAD model.

In some embodiments, a vacuum source (not shown) may also be provided to assist in drawing abrasives from the abrasive feed system 48 into the fluid from the fluid source 42 to produce a consistent abrasive fluid jet to enable particularly accurate and efficient workpiece processing. The same or a different vacuum source may also be coupled to the jet receiving receptacle 22 to assist in withdrawing contents of the fluid jet received by the receptacle 22 during operation.

Further details of the controller 40, robotic motion system 12 and other systems and subsystems associated with fluid jet cutting systems (e.g., abrasive feed system 48), however, are not shown or described in detail to avoid unnecessarily obscuring descriptions of the embodiments.

FIGS. 4 through 7 show another example embodiment of a fluid jet cutting system 110. The fluid jet cutting system 110 includes a multi-axis robotic motion system 112, such as an industrial multiaxial robotic arm, which is configured to manipulate a workpiece 114 (e.g., composite aircraft parts) within a working envelope of the motion system 112 defined by its range of motion to be processed by a high pressure fluid jet (e.g., waterjet or abrasive waterjet). The robotic motion system 112 may include an end effector 115, such as a gripper, at the working end thereof for selectively gripping the workpiece 114 for manipulation opposite the fluid jet.

Figure 5:
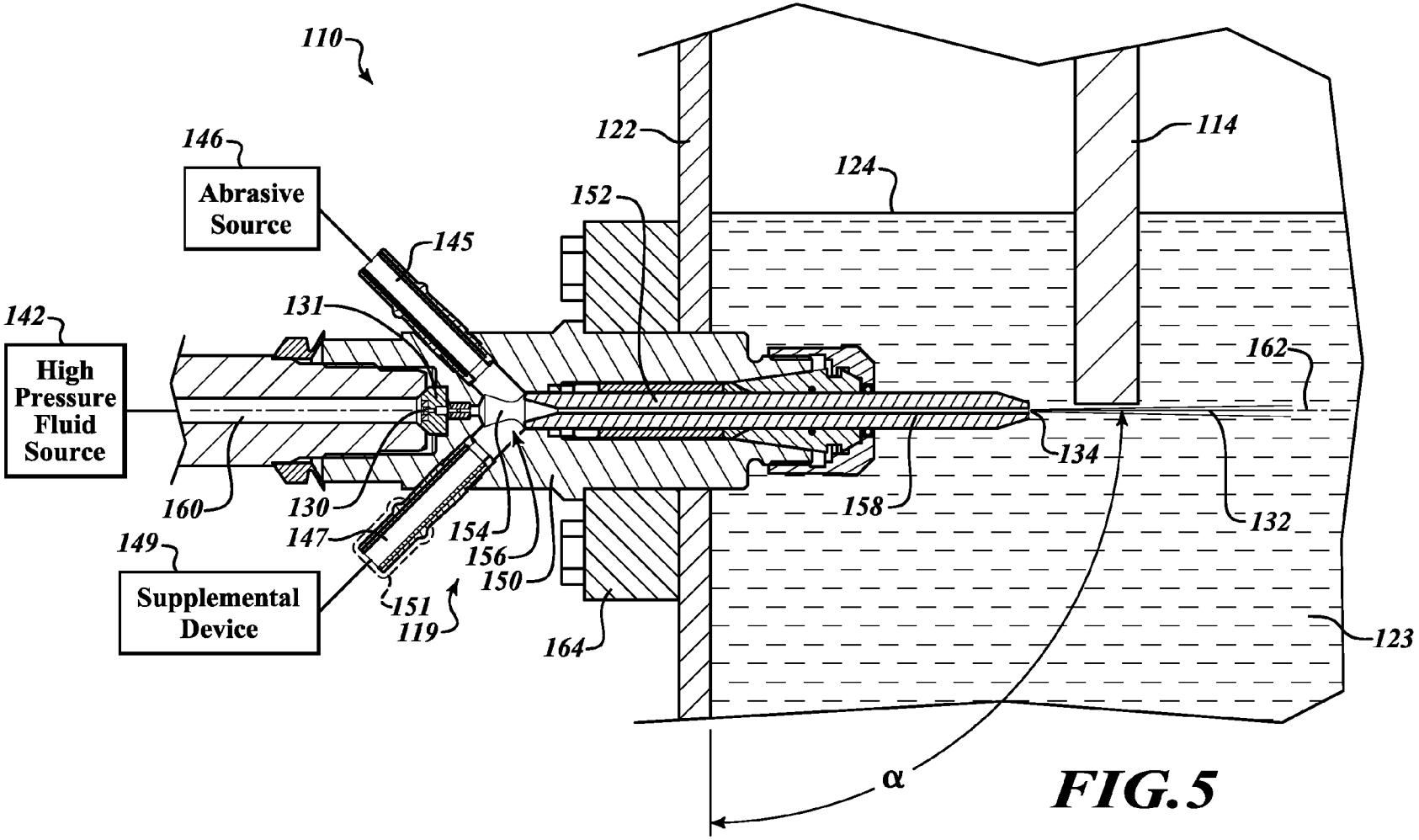
FIG. 5 is a cross-sectional view of a portion of the fluid jet cutting system of FIG. 4 showing a cutting head thereof extending through a sidewall of a catcher tank for discharging a fluid jet toward a workpiece that is at least partially submerged within the tank.

The fluid jet cutting system 110 further includes a tank 122 and one or more fluid jet cutting heads 118, 119 (two shown). The tank 122 is positioned within the working envelope of the multi-axis robotic motion system 112 to enable the workpiece 114 to be at least partially submerged under fluid 123 (e.g., water) within the tank 122 during workpiece processing operations. Each of the fluid jet cutting heads 118, 119 may include an orifice member 130 (e.g., a jewel orifice carried by an orifice mount 131), as shown in FIG. 5, to generate a high pressure fluid jet 132 and a fluid jet outlet 134 from which to discharge the high pressure fluid jet 132. The cutting heads 118, 119 are located relative to the tank 122 such that, during processing of the workpiece 114 by one of the cutting heads 118, 119, the high pressure fluid jet 132 discharges from the fluid jet outlet 134 of the selected cutting head 118, 119 beneath an upper surface 124 of the fluid 123 within the tank 122, cuts through the workpiece 114, and dissipates within a region of the fluid 123 in the tank 122 located adjacent a side of the workpiece 114 opposite the selected cutting head 118, 119.

FIG. 5 shows further details of one embodiment of a cutting head 119 which can be used in connection with the example embodiment of the fluid jet cutting system 110 shown in FIGS. 4 through 7, and the other embodiments of the fluid jet cutting systems 10, 210, 310, 410 and related methods described herein. The cutting head 119 includes an abrasive inlet 145 coupled to an abrasive source 146 and includes a supplemental port 147 that may be coupled to a supplemental device 149, such as, for example, a vacuum source to assist in drawing abrasives into the cutting head 119. In other instances, the supplemental device 149 may be a secondary abrasive feed source, a pressurized air source, or other device that assists or augments the operation of the cutting head 119. In some instances, a supplemental device 149 may not be provided and the supplemental port 147 may be sealed with a cap 151. In other instances, the cutting head 119 may not include a supplemental port 147.

The cutting head 119 also includes a cutting head body 150, the orifice member 130 for producing the fluid jet 132 within the cutting head body 150, and a mixing tube 152 coupled to the body 150. The cutting head body 150 has an interior surface 154 that defines at least a portion of a mixing chamber 156. In some embodiments, including the embodiment illustrated in FIG. 5, the mixing chamber 156 is generally the space between the orifice mount 131, which supports the orifice member 130, and the mixing tube 152. The abrasive inlet 145 defines at least a portion of a flow path between the abrasive source 146 and the mixing chamber 156, and the supplemental port 147, when provided, defines at least a portion of a flow path between the mixing chamber 156 and the supplemental device 149.

The cutting head body 150 can have a one-piece construction and can be made, in whole or in part, of one or more metals (e.g., steel, high strength metals, etc.), metal alloys, or the like. The cutting head body 150 may include threads or other coupling features for coupling to other components of the cutting head 119. The orifice mount 131 is fixed with respect to the cutting head body 150 and includes a recess dimensioned to receive and hold the orifice member 130. The orifice member 130 is kept in alignment with the mixing chamber 156, a passageway 158 of the mixing tube 152, and an upstream passageway 160 in fluid communication with a high pressure fluid source 142. The orifice member 130, in some embodiments, is a jewel orifice or other fluid jet or cutting stream producing device used to achieve the desired flow characteristics of the resultant fluid jet 132. The opening of the orifice member 130 can have a diameter in a range of about 0.001 inch (0.025 mm) to about 0.02 inch (0.5 mm). Openings with other diameters can also be used, if needed or desired.

The orifice mount 131 defines an upstream end of the mixing chamber 156, and the mixing tube 152 defines a downstream end of the mixing chamber 156. The mixing chamber 156 includes a relatively wide central region in which abrasives for the abrasive source 146 may be entrained in the fluid jet 132. The illustrated mixing chamber 156 has a cross-sectional area that is larger than a cross-sectional area of the passageway 158 of the mixing tube 152. The illustrated mixing chamber 156 of FIG. 5 is a single-stage entrainment chamber in which substantially the entire entrainment process occurs. A stream of abrasives can be continuously entrained in at least a portion of a section of the fluid jet 132 between the orifice mount 131 and the mixing tube 152. The illustrated fluid jet 132 exits the orifice member 130 directly into the mixing chamber 156. Abrasives fed or drawn into the mixing chamber 156, with optional assistance of a vacuum device, are entrained in the fluid jet 132 to form the abrasive fluid jet 132 flowing through the passageway 158 of the mixing tube 152. The abrasives may be entrained before entering an upstream end of the mixing tube 152. The entrained abrasive may continue to mix together while traveling along the passageway 158 of the mixing tube 152. The fluid jet 132 is ultimately discharged from the outlet 134 generally along a central axis 162 defined by the mixing tube 152 for processing the workpiece 114.

The cutting head 119 may further include a mount 164 for coupling the cutting head 119 to the tank 122 or to another structure in the vicinity of the tank 122. According to the example embodiment shown in FIG. 5, the cutting head 119 is attached to a sidewall of the tank 122 and extends through the sidewall of the tank 122 such that the fluid jet outlet 134 is positioned beneath the upper surface 124 of the fluid 123 within the tank 122 during processing operations. A fluid-level adjustment system (not shown) may be provided to adjust the level of fluid 123 in the tank 122 to ensure the fluid jet outlet 134 is submerged when processing the workpiece 114. The level of fluid 123 may be lowered to enable inspection of the workpiece 114 while the workpiece 114 is still positioned opposite the cutting head 119. In some embodiments, an inspection station may be located outside of the tank 122 within the working envelope defined by the range of motion of the multi-axis robotic motion system 112 to enable inspection of the workpiece 114 prior to or after submersion and processing within the tank 122. The cutting head 119 may be mounted to the tank 122 such that the central axis 162 is aligned horizontal or generally horizontal. In other embodiments, the cutting head 119 may be mounted to the tank 122 such that the central axis 162 is inclined relative to a horizontal reference plane. For example, the central axis 162 may be inclined downwardly to discharge the fluid jet 132 at least partially toward a floor of the tank 122.

In still further embodiments, the cutting head 119 may be mounted to the tank 122 via a manipulable joint (not shown). The manipulable joint may be manually or automatically adjustable to enable selective adjustment of an angle a of the cutting head 119 relative to the tank 122. For example, the manipulable joint may be coupled to a motor and a controller (not shown) to enable controlled adjustment of the angle a of the cutting head 119 prior to and/or during cutting operations. The angle a of the cutting head 119 can be adjusted manually or automatically to, among other things, minimize surface turbulence during cutting operations or allow easier manipulation of workpieces 114 opposite the discharged fluid jet 132 thereof. Other cutting heads, such as, for example, cutting head 118, may be supported in a similar manner to enable angular adjustment of such cutting heads relative to the tank 122 or other fixture.

Figure 6:
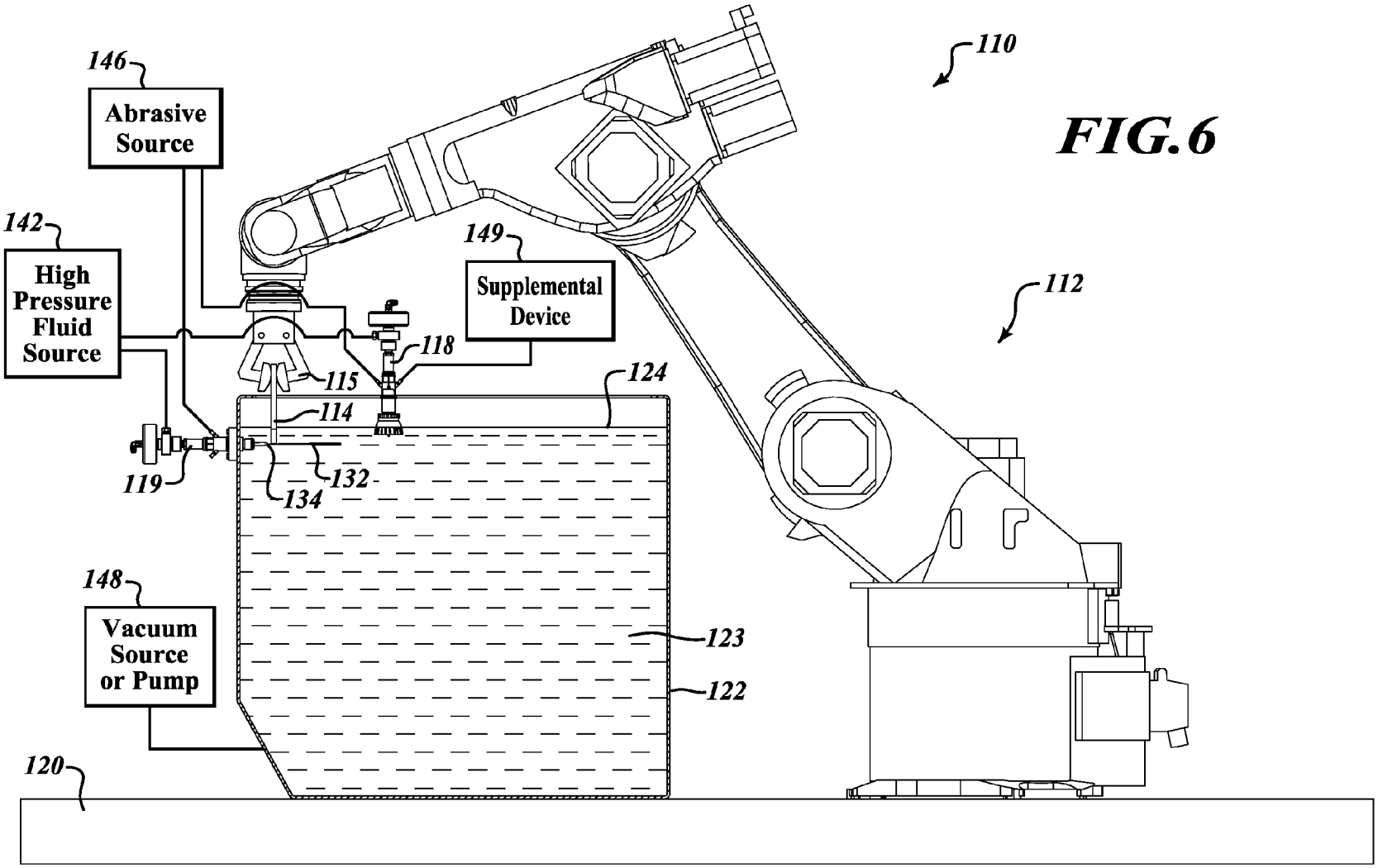
FIG. 6 is a side elevational view of the fluid jet cutting system of FIG. 4 with the multi-axis robotic motion system shown positioning a workpiece opposite one of a plurality of cutting heads positioned within a working envelope of the multi-axis robotic motion system.
Figure 7:
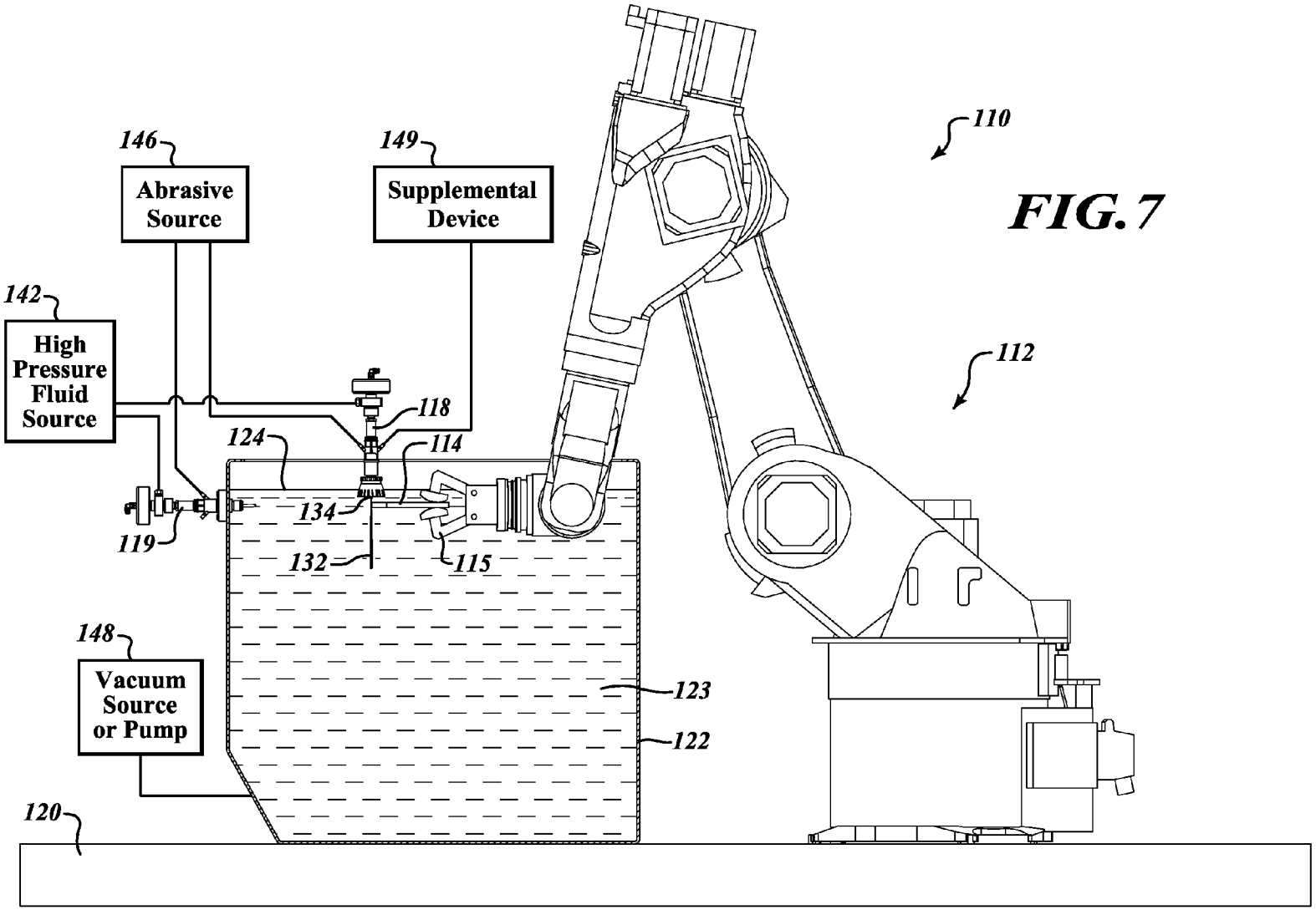
FIG. 7 is a side elevational view of the fluid jet cutting system of FIG. 4 with the multi-axis robotic motion system shown positioning the workpiece opposite another one of the plurality of cutting heads.

FIGS. 6 and 7 show the multi-axis robotic motion system 112 in two different configurations with the workpiece 114 positioned opposite each of two separate cutting heads 118, 119. More particularly, FIG. 6 shows the multi-axis robotic motion system 112 positioning the workpiece 114 opposite a horizontally oriented cutting head 119 that extends through the sidewall of the tank 122, as discussed above, and FIG. 7 shows the multi-axis robotic motion system 112 positioning the workpiece 114 opposite a vertically mounted cutting head 119 that is positioned above the tank 122 such that the fluid jet 132 is discharged downwardly from fluid jet outlet 134 during processing operations. The cutting heads 118, 119 may be provided to discharge fluid jets 132 in two primary directions that are perpendicular to each other. In other instances, discharge directions of the fluid jets 132 discharge by the cutting heads 118, 119 may be non-orthogonal or skewed relative to each other. In still other instances, one or more of the cutting heads 118, 119 may be adjustably mounted to allow the discharged jet 132 to be reoriented as desired, before, after and/or during processing operations.

Although two separate distinct cutting heads 118, 119 are shown, it is appreciated that in some embodiments more cutting heads 118, 119 may be provided, and in other embodiments only a single cutting head 118, 119 may be provided in conjunction with the tank 122 and multi-axis robotic motion system 112. Having a plurality of cutting heads 118, 119, however, provides versatility with respect to processing a wide variety of workpieces and performing a wide variety of processing operations, such as, for example, cutting a complex profile of a workpiece 114 in a submerged environment. At least one fluid jet cutting head 118 may be spaced away from the sidewalls of the tank 122 to permit the multi-axis robotic motion system 112 to maneuver the workpiece 114 beneath the discharged fluid jet 132 without obstruction from sidewalls of the tank 132.

With continued reference to FIGS. 6 and 7, at least one fluid jet cutting head 118 may be suspended above or otherwise positioned above the tank 122 with a portion thereof (e.g., a cutting head body 150) located above the upper surface 124 of the fluid 123 during processing operations and with a portion thereof (e.g., at least a portion of mixing tube 152) submerged below the upper surface 124 of the fluid 123. Accordingly, the cutting head 118 may span across the upper surface 124 of the fluid 123 with its fluid jet outlet 134 submerged during cutting and other processing operations. The cutting head 118 may be rigidly or fixedly secured in space above the tank 122. In other instances, the cutting head 118 may be mounted to a swing arm or other support structure (not shown) to enable the cutting head 118 to move from a stowed configuration in which the cutting head 118 may be outside of the working envelope of the multi-axis robotic motion system 112 and a deployed configuration in which the cutting head 118 is positioned above or within the tank 122 with its fluid jet outlet 134 submerged. The tank 122, the multi-axis robotic motion system 112 and any support structures (not shown) that support one or more of the cutting heads 118, 119 may be fixed to a common foundation 120 and/or may be located within an enclosed or partially enclosed work cell.

Similar to aforementioned embodiments, and with continued reference to FIGS. 6 and 7, other systems and subsystems associated with fluid jet cutting systems may also be provided such as, for example, a high-pressure or ultrahigh-pressure fluid source 142 (e.g., direct drive and intensifier pumps with pressure ratings ranging from 40,000 psi to 100,000 psi and higher) for supplying high pressure or ultrahigh pressure fluid (e.g., high pressure water) to the cutting heads 118, 119 and/or an abrasive source 146 (e.g., abrasive hopper and distribution system) for feeding abrasives to the cutting heads 118, 119 to enable abrasive fluid jet cutting. In some embodiments, a supplemental device 149 may be coupled to the cutting heads 118, 119 to provide additional functionality. For example, a vacuum source may be provided to assist in drawing abrasives into the cutting heads 118, 119. In other instances, the supplemental device 149 may be a secondary abrasive feed source, a pressurized air source, or other device that assists or augments the operation of the cutting heads 118, 119. In addition, a vacuum source or pump 148 may be coupled to a tank 122 to enable the withdrawal of contents from the tank 122 for disposal of the contents or reconditioning and reuse thereof. The high pressure fluid source 142, abrasive source 146, the cutting heads 118, 119, the multi-axis robotic motion system 112 and/or other functional components of the fluid jet system 110 (e.g., supplemental device 149) may also be coupled to a controller (not shown) or controllers in order to enable coordinated operation of the same. For example, according to one embodiment, the orientation of the cutting heads 118, 119 may be adjusted and coordinated with operation of a vacuum source or pump 148 such that the discharged fluid jets 132 assist in cleaning the tank 122 by dislodging spent abrasives from the bottom of the tank 122 while the vacuum source or pump 148 withdraws the same. Further details of the controller, robotic motion system 112 and other known systems (e.g., high pressure fluid source 142) associated with fluid jet cutting systems are not shown or described in detail to avoid unnecessarily obscuring descriptions of the embodiments.

Figure 8:
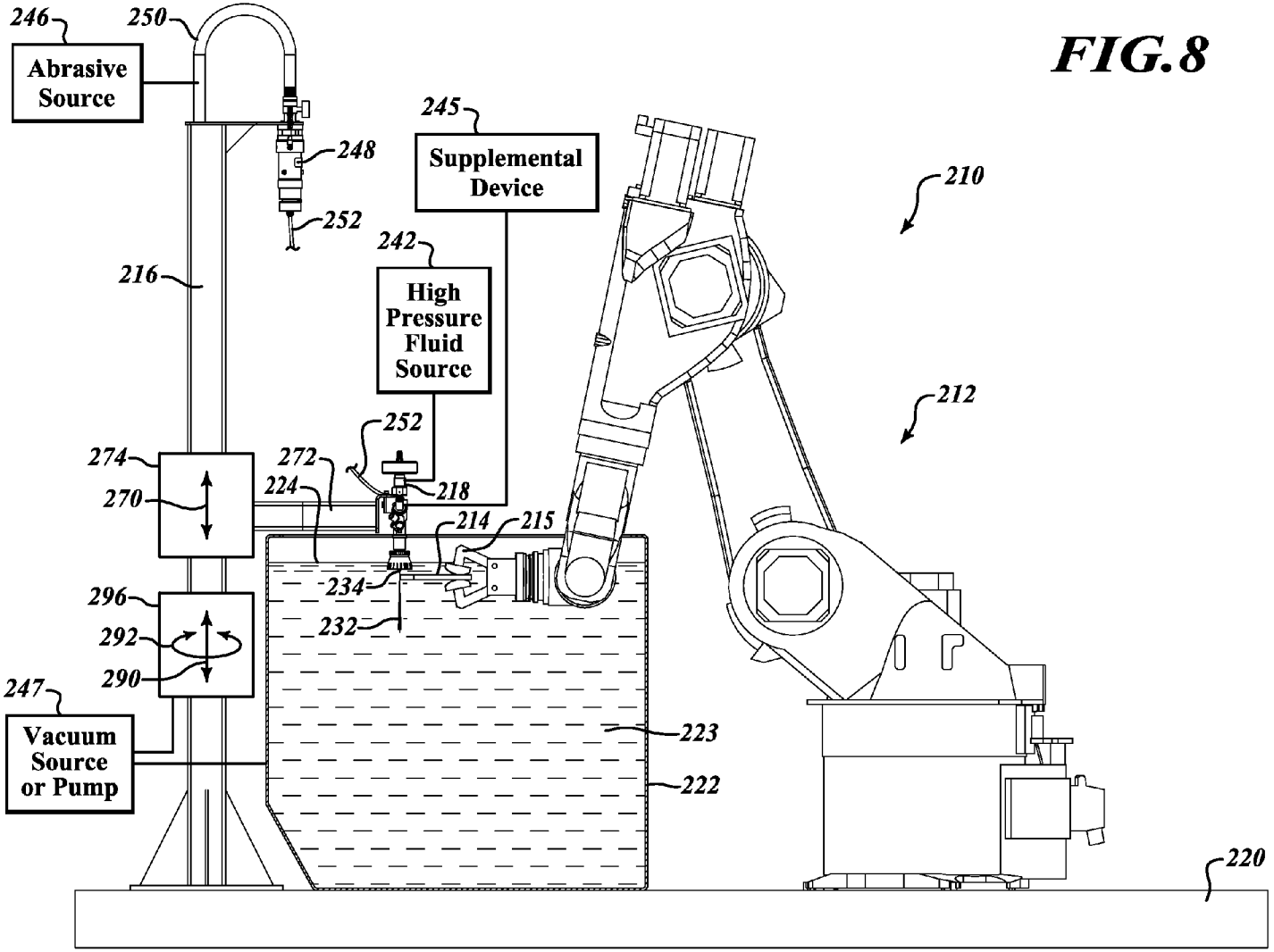
FIG. 8 is a side elevational view of a fluid jet cutting system, according to another embodiment, shown with a multi-axis robotic motion system positioning a workpiece opposite a cutting head with the workpiece at least partially submerged within a catcher tank.
Figure 9:
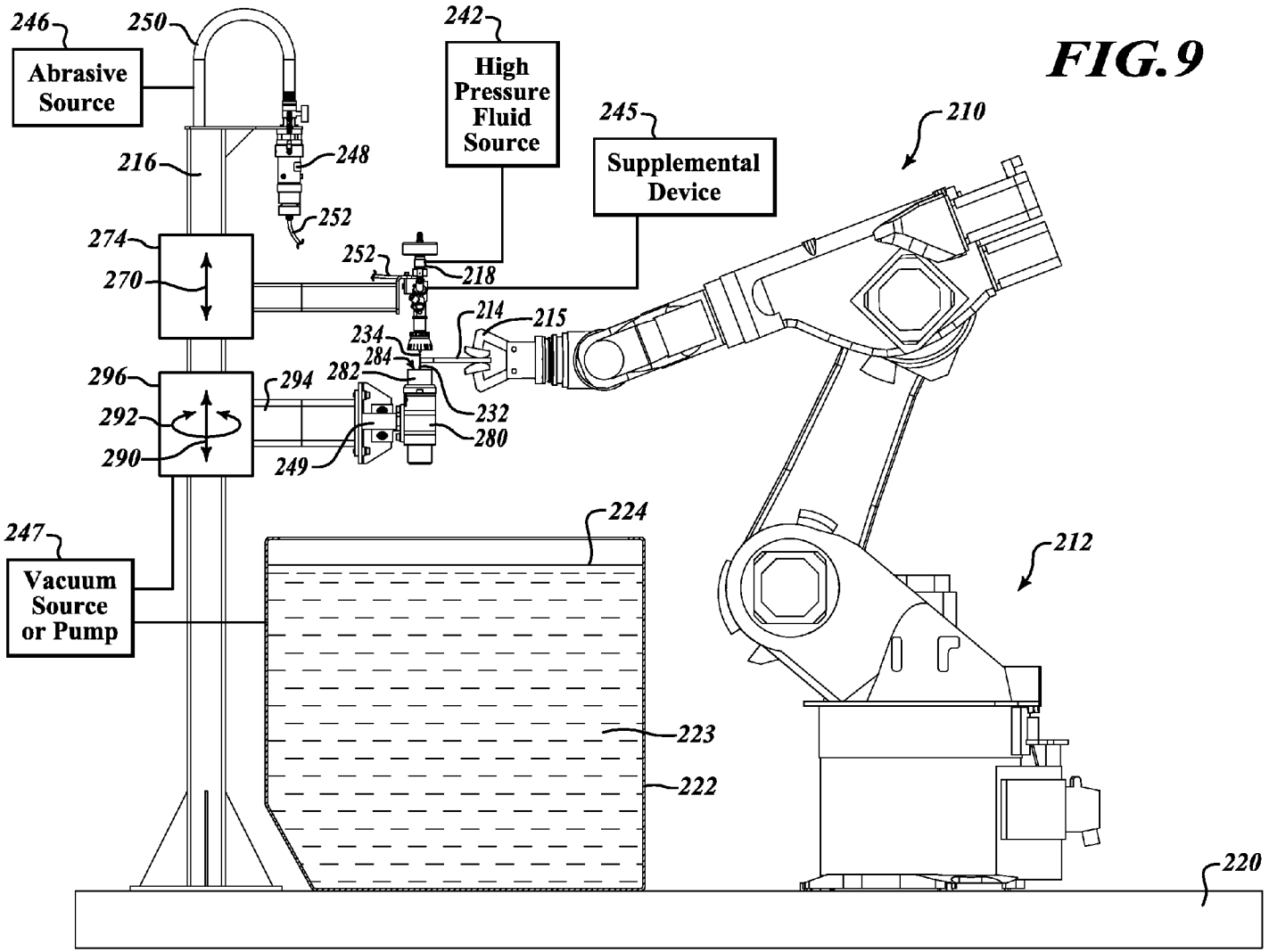
FIG. 9 is a side elevational view of the fluid jet cutting system of FIG. 8 shown with the multi-axis robotic motion system positioning the workpiece between the cutting head and a jet receiving receptacle.

With reference to FIGS. 8 and 9, a fluid jet cutting system 210 according to another embodiment is shown for processing workpieces using one of a plurality of alternate processing arrangements. The processing arrangements may include a submerged processing arrangement, as shown in FIG. 8, and a non-submerged processing arrangement, as shown in FIG. 9. The fluid jet cutting system 210 includes a multi-axis robotic motion system 212, such as an industrial multiaxial robot, which is configured to manipulate a workpiece 214 within a working envelope of the motion system 212 defined by its range of motion to be processed by a high pressure fluid jet 232 (e.g., waterjet or abrasive waterjet). The robotic motion system 212 may include an end effector 215, such as a gripper, at the working end thereof for selectively gripping the workpiece 214 for manipulation of the workpiece 214 opposite the fluid jet 232.

The fluid jet cutting system 210 further includes a tank 222 and at least one fluid jet cutting head 218 configured to selectively generate the high pressure fluid jet 232. The tank 222 is positioned within the working envelope of the multi-axis robotic motion system 212 to enable the workpiece 214 to be at least partially submerged under fluid 223 (e.g., water) within the tank 222 during a submerged processing operation. More particularly, the fluid jet cutting head 218 includes an orifice member (e.g., a jewel orifice) to generate a high pressure fluid jet 232 and a fluid jet outlet 234 from which to discharge the high pressure fluid jet 232. The cutting head 218 is positionable relative to the tank 222 such that, during processing of the workpiece 214, the high pressure fluid jet 232 may be discharged from the fluid jet outlet of the cutting head beneath an upper surface 224 of the fluid 223 within the tank 222 to cut through the workpiece 214 to dissipate within a region of the fluid 223 in the tank 222 located adjacent a side of the workpiece 214 opposite the cutting head 218.

More particularly, the cutting head 218 may be movably coupled to a support structure 216 to enable the cutting head 218 to be moved between a submerged processing position, shown in FIG. 8, and a non-submerged processing position, shown in FIG. 9, as represented by the arrows labeled 270. The cutting head 218 may be coupled to the support structure 216 by a support arm 272 and a carriage or base 274 that is configured to translate or ride up and down an upstanding portion of the support structure 216. The vertical position of the cutting head 218 along the support structure 216 may be manually adjustable or controllably adjustable. A lock (not shown) or other fastening device may be provided to secure the cutting head 218 in the submerged processing position, shown in FIG. 8, or the non-submerged processing position, shown in FIG. 9, or in intermediate positions therebetween.

With reference to FIG. 9, the fluid jet cutting system 210 may further include a jet receiving receptacle 280 having a fluid jet inlet feed component 282 with an inlet aperture 284 for receiving and capturing the fluid jet 232 discharged from the cutting head 218 when operating in the non-submerged processing position. The jet receiving receptacle 280 may be movably coupled to the support structure 216 to enable the receptacle 280 to be moved between an active or deployed position for processing the workpiece 214, as shown in FIG. 9, and an inactive or stowed position, as shown in FIG. 8. The receptacle 280 may be coupled to the support structure 216 by a support arm 294 and a carriage or base 296 that may be configured to translate or ride up and down the upstanding portion of the support structure 216, as represented by the arrows labeled 290. The vertical position of the receptacle 280 along the support structure 216 may be manually adjustable or controllably adjustable. In addition, the carriage or base 296 may be configured to rotate around the upstanding portion of the support structure 216, as represented by the arrow labeled 292. In this manner, the support arm 294 and receptacle 280 can be swung out of the way of the tank 222 and stored in a manner so as to not obstruct or interfere with processing the workpiece 214 within the tank 222. A lock (not shown) or other fastening device may be provided to secure the receptacle 280 in the active or deployed position shown in FIG. 9, or the inactive or stowed position shown in FIG. 8, or in other positions of interest. Advantageously, the fluid jet cutting system 210 provides enhanced versatility with respect to handling and processing a wide variety of workpieces 214. The tank 222, the multi-axis robotic motion system 212, the support structure 216 and components supported thereon may be fixed to a common foundation 220 and/or may be located within an enclosed or partially enclosed work cell.

Similar to aforementioned embodiments, and with continued reference to FIGS. 8 and 9, other systems and subsystems associated with fluid jet cutting systems may also be provided such as, for example, a high-pressure or ultrahigh-pressure fluid source 242 (e.g., direct drive and intensifier pumps with pressure ratings ranging from 40,000 psi to 100,000 psi and higher) for supplying high pressure or ultrahigh pressure fluid (e.g., high pressure water) to the cutting head 218 and/or an abrasive source 246 (e.g., abrasive hopper and distribution system) for feeding abrasives to the cutting head 218 to enable processing with abrasive fluid jets. The abrasive source 246 may supply abrasives (e.g., garnet particles) to an abrasive feed system 248 via one or more abrasive supply conduits 250. The abrasive feed system 248 may be provided in close proximity to the cutting head 218 and positioned above the cutting head 218 to selectively feed abrasives to the cutting head 218 via one or more abrasive feed conduits 252. The high pressure fluid source 242, abrasive source 246, abrasive feed system 248, the cutting head 218, the multi-axis robotic motion system 212 and/or other functional components of the fluid jet system 210 may also be coupled to a controller (not shown) or controllers in order to enable coordinated operation of the same.

In some embodiments, a supplemental device 245 may be coupled to the cutting heads 218, 219 to provide additional functionality. For example, a vacuum source may be provided to assist in drawing abrasives into the cutting heads 218, 219. In other instances, the supplemental device 245 may be a secondary abrasive feed source, a pressurized air source, or other device that assists or augments the operation of the cutting heads 218, 219. In addition, a vacuum source or pump 247 may be coupled to the jet receiving receptacle 280 via a conduit 249 (FIG. 9) to assist in withdrawing contents of the fluid jet 232 received by the receptacle 280 during operation. Still further, the same or a different vacuum source or pump 247 may also be coupled to the tank 222 to enable the withdrawal of contents from the tank 222 for disposal or reconditioning and reuse.

With reference to FIG. 9, and according to some embodiments, contents withdrawn from the fluid jet receptacle 280 may be routed via one or more conduits 249 to the tank 222 to be discharged therein. An outlet of the fluid jet receptacle 280 may also be in fluid communication with the tank 222 and submerged under water to assist in dampening noise otherwise generated during withdrawal of contents from the jet receiving receptacle 280 during operation.

Further details of the controller, robotic motion system 212 and other known systems associated with fluid jet cutting systems (e.g., abrasive feed system 248) are not shown or described in detail to avoid unnecessarily obscuring descriptions of the embodiments.

FIGS. 10 and 11A-11C show yet another embodiment of a fluid jet cutting system 310. The fluid jet cutting system 310 includes a fluid jet cutting head 318 having an orifice to generate a high pressure fluid jet 332 and a fluid jet outlet 334 from which to discharge the high pressure fluid jet 332. A jet receiving receptacle 322 (shown only partially in FIGS. 11A-11C for clarity) is provided generally opposite the cutting head 318 to receive the high pressure fluid jet 332 after the high pressure fluid jet 332 passes through a workpiece 314 during processing operations. The jet receiving receptacle 322 may include an inlet feed component 324 having an inlet aperture 326 for receiving the fluid jet 332 during operation. A discharge conduit 328 is provided to withdraw the contents of the fluid jet 332 captured by the jet receiving receptacle 322 during operation.

Figure 10:
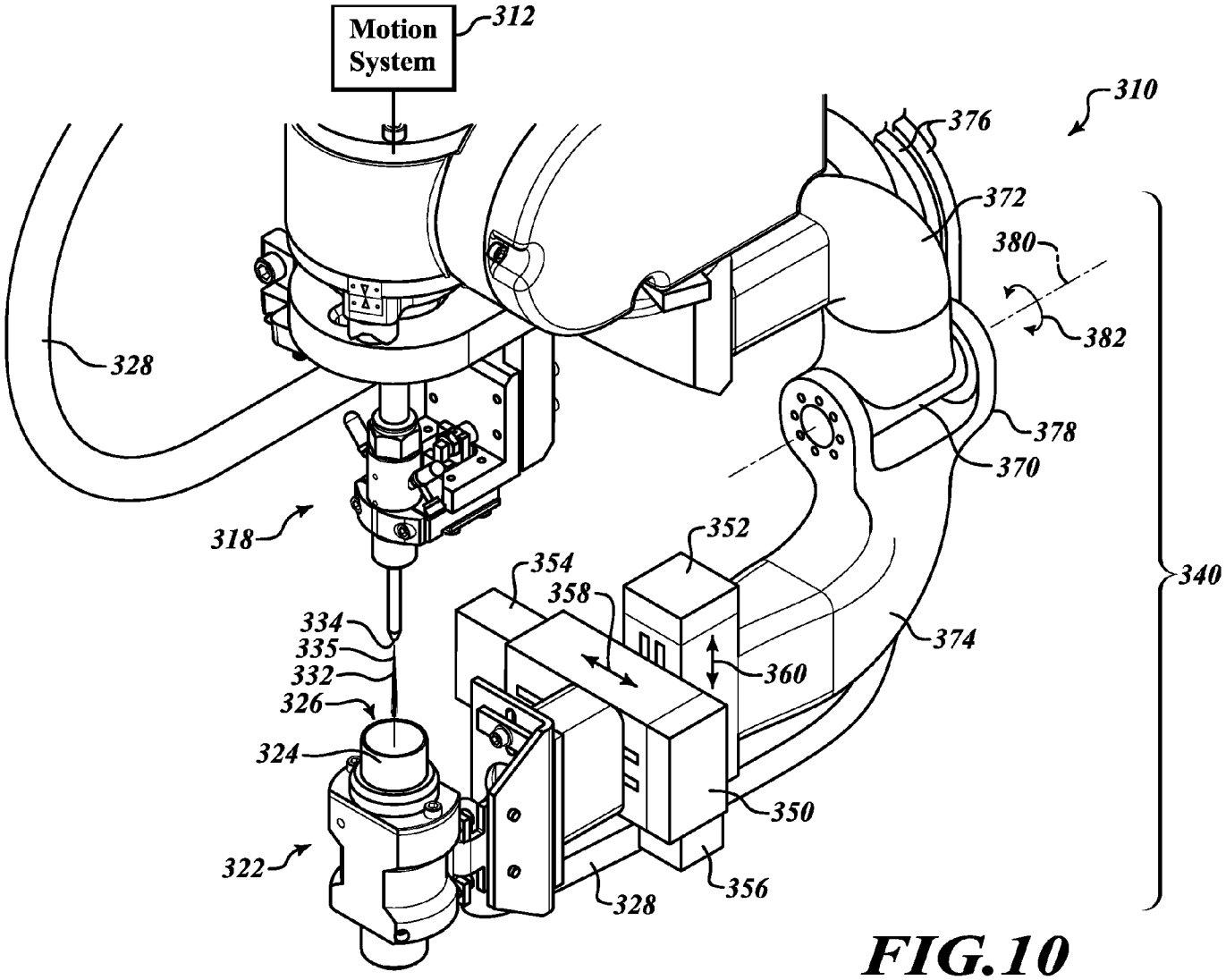
FIG. 10 is an isometric view of a fluid jet cutting system, according to another embodiment, having a jet receiving receptacle positioned opposite a cutting head.

With reference to FIG. 10, the fluid jet cutting system 310 may further include a support structure 340 to support the jet receiving receptacle 322 generally opposite the cutting head 318. The support structure 340 may include a drive system comprising one or more linear or rotary positioners 350, 352, 370 to selectively adjust a lateral position of the jet receiving receptacle 322, an axial position of the jet receiving receptacle 322 and/or an angular orientation of the jet receiving receptacle 322 relative to an axis 335 defined by the fluid jet outlet 334 of the fluid jet cutting head 318.

For instance, the example embodiment of the fluid jet cutting system 310 shown in FIG. 10, includes a drive system having two linear positioners 350, 352 with associated motors 354, 356, which are oriented perpendicular to each other to provide lateral and axial adjustment of the jet receiving receptacle 322, as represented by the arrows labeled 358, 360. The drive system further includes a rotator or swivel 370 coupled between opposing arm portions 372, 374 of the support structure 340. The rotator or swivel 370 may be, for example, a hydraulic rotator or swivel controlled by hydraulic fluid supplied and returned via respective hydraulic lines 376. One of the arm portions 374 is shown with a clevis structure 378 for coupling to the rotator or swivel 370 to enable the arm portion 374 to rotate or swivel relative to the other arm portion 372 about a rotational axis 380 to selectively tilt the jet receiving receptacle 322, as represented by the arrows labeled 382.

Figure 11C:
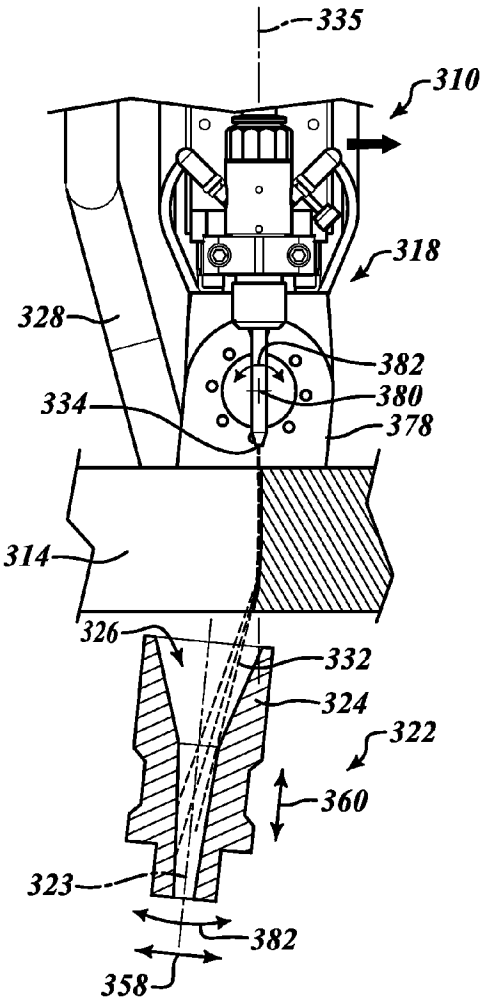
FIGS. 11A-11C are front elevational views of the fluid jet cutting system of FIG. 10 with a portion of the jet receiving receptacle shown in different example positions and/or orientations relative to the cutting head.
Figure 11B:
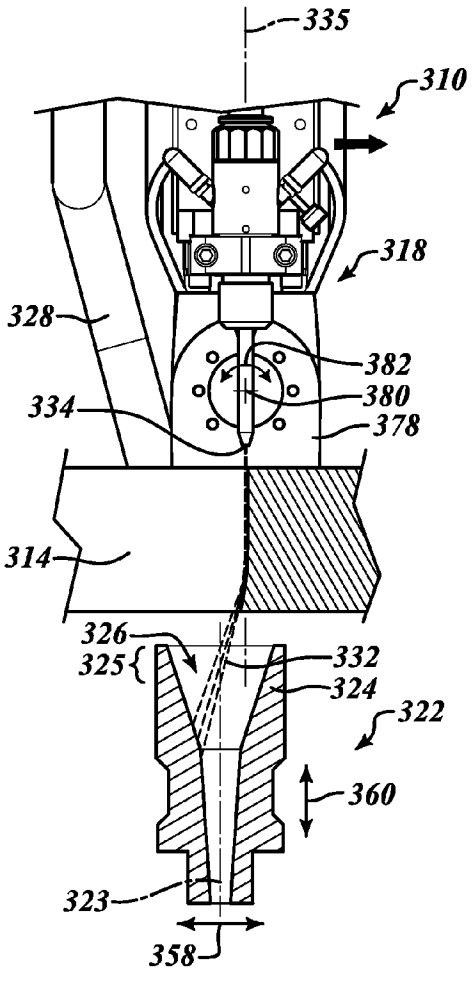
Figure 11A:
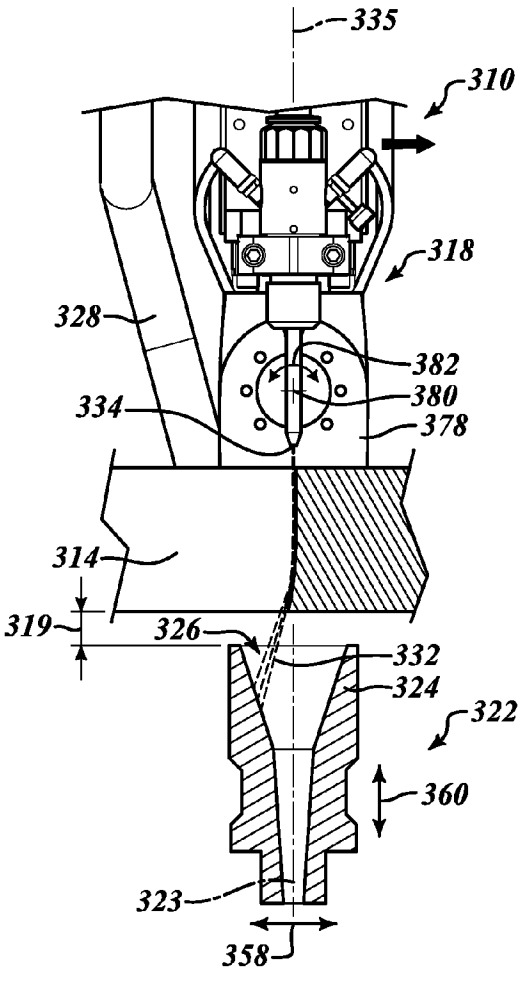

With reference to FIG. 11A, the drive system of the fluid jet cutting system 310 may be controllable to adjust an axial position of the jet receiving receptacle 322 relative to the cutting head 318, as represented by the arrows labeled 360. In this manner, the inlet feed component 324 of the jet receiving receptacle 322 can be brought into close proximity to the workpiece 314 to reduce or minimize a distance 327 between a side of the workpiece 314 opposite the cutting head 318 and the inlet feed component 324. This can assist in reducing or minimizing sound generated during a cutting process and may also ensure that the incoming jet 332, which may be deflected from a discharge direction by its interaction with the workpiece 314 as illustrated in FIG. 11A, is better aligned with the inlet aperture 326 of the inlet feed component 324. The axial position of the jet receiving receptacle 322 may be adjusted during processing in accordance with one or more variables, including, for example, the topography of the workpiece 114 being processed.

With reference to FIG. 11B, the drive system of the fluid jet cutting system 310 may be controllable to adjust a lateral position of the jet receiving receptacle 322 relative to the cutting head 318, as represented by the arrows labeled 358. In this manner, the inlet feed component 324 of the jet receiving receptacle 322 can be controlled to align a central axis 323 of the fluid jet receptacle 322 to intersect with the high pressure fluid jet in a deflected state within an inlet portion 325 at the distal end of the fluid jet receptacle 322 during workpiece processing. The lateral position of the jet receiving receptacle 322 may be adjusted during processing in accordance with one or more variables, including, for example, at which the cutting head 318 moves relative to the workpiece 114, or the speed at which the workpiece 114 moves relative to the cutting head 318.

With reference to FIG. 11C, the drive system of the fluid jet cutting system 310 may be controllable to independently adjust a lateral position, an axial position and an angular orientation of the jet receiving receptacle 322 relative to the cutting head 318, as represented by the arrows labeled 358, 360 and 382, respectively. In this manner, the inlet feed component 324 of the jet receiving receptacle 322 can be controlled to align the central axis 323 of the fluid jet receptacle 322 to be relatively more parallel to the high pressure fluid jet 332 in its deflected state during workpiece processing. In some instances, the inlet feed component 324 of the jet receiving receptacle 322 can be controlled to align a central axis 323 of the fluid jet receptacle 322 to be parallel or generally parallel to the high pressure fluid jet 332 in its deflected state during workpiece processing.

It is appreciated that amount of lateral adjustment, axial adjustment, and/or angular adjustment may be a function of several variables. These variables may include, for example, the speed at which the cutting head 318 is moved relative to the workpiece 314 or the speed at which the workpiece 314 is moved relative to the cutting head 318, the type of material being processed (e.g., steel versus composite materials), and the thickness or topography of the workpiece 314 being processed. Moreover, fluid jet process models, such as those described in Flow's U.S. Pat. No. 6,766,216, which is incorporated herein by reference in its entirety, may be used to calculate the expected deflection of the fluid jet 332. The position and/or orientation of the jet receiving receptacle 322 may then be adjusted based at least in part upon such calculations. In some instances, one or more sensors (not shown) may be provided to sense a position and/or orientation of the fluid jet receptacle 322 for feedback adjustment purposes. In some instances, the axial position, the lateral position and/or angular orientation of the jet receiving receptacle 322 may be selected and held constant throughout at least a portion of a cutting operation. In some instances, the axial position, the lateral position and/or angular orientation of the jet receiving receptacle 322 may be adjusted throughout a cutting operation or portions thereof. Advantageously, the jet receiving receptacle 322 can be controlled to capture the incoming fluid jet 332 in a manner that reduces noise and splash back.

Generally, one or more drive components may be provided to manipulate the position and/or orientation of the jet receiving receptacle 322 relative to the cutting head 318 during operation. The position and orientation of the jet receiving receptacle 322 may be coordinated with the velocity and/or trajectory of the cutting head 318 during operation to optimize or otherwise manipulate contact of the discharged jet 332 with the jet receiving receptacle 322. For example, relatively higher cutting speeds may result in greater jet deflection from a central axis 335 of the cutting head 318 and the jet receiving receptacle 322 may be controlled to be laterally adjusted to a greater distance or tilt to a greater degree in such instances to receive the deflected jet 332 in a more coaxial manner.

In some embodiments, the cutting head 318 may be positioned and held generally opposite the jet receiving receptacle 322 while the workpiece 314 is passed therebetween, such as, for example, by a multi-axis robotic motion system. In other embodiments, the fluid jet cutting system 310 may include a different motion system, such as, for example, a gantry style motion system, that is coupled to the fluid jet cutting head 318 to controllably manipulate the fluid jet cutting head 318 in space.

As an example, the fluid jet cutting system 310 may include a motion system 312 (FIG. 10) comprising a bridge assembly that is movable along a pair of base rails. In operation, the bridge assembly can move back and forth along the base rails with respect to a translational axis to position the cutting head 318 of the system 310 for processing a workpiece 314. In addition, a tool carriage may be movably coupled to the bridge assembly to translate back and forth along another translational axis, which is aligned perpendicularly to the first translational axis. The tool carriage may be further configured to raise and lower the cutting head 318 along yet another translational axis to move the cutting head 318 toward and away from the workpiece 314. Still further, a manipulable forearm and a manipulable wrist may be provided intermediate the cutting head 318 and the tool carriage to provide additional functionally. More particularly, a forearm of the motion system may be rotatably coupled to the tool carriage to rotate the cutting head 318 about a first axis of rotation. A wrist of the motion system may be rotatably coupled to the forearm to rotate the cutting head 318 about another axis of rotation that is non-parallel to the aforementioned rotational axis. In combination, the rotational axes enable the cutting head 318 to be manipulated in a wide range of orientations relative to the workpiece 314 to facilitate, for example, cutting of complex profiles. The rotational axes may converge at a focal point, which in some embodiments may be offset from the end or tip of the cutting head 318. The end or tip of the cutting head 318 is preferably positioned at a desired standoff distance from the workpiece 314 to be processed. The standoff distance may be selected or maintained at a desired distance to optimize the cutting performance of the fluid jet. During operation, movement of the cutting head 318 with respect to each of the translational axes and rotational axes may be accomplished by various conventional drive components and an appropriate controller (not shown).

Figure 12:
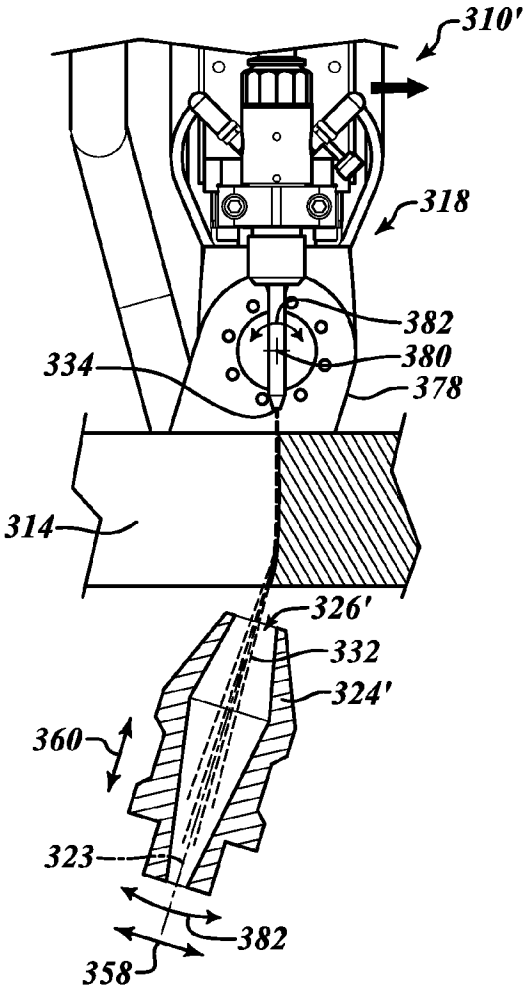
FIG. 12 is a front elevational view of the fluid jet cutting system of FIG. 10 with an alternate jet receiving receptacle shown in different example positions and/or orientations relative to the cutting head.

FIG. 12 shows a fluid jet system 310' similar to the aforementioned system 310 but wherein an inlet feed component 324' includes a distal portion having an external surface that tapers inwardly in an upstream direction (i.e., a direction generally opposite the direction of the incoming fluid jet 332) to provide additional workpiece clearance in a region immediately adjacent to and downstream of the inlet aperture 326' thereof. Advantageously, the inlet feed component 324' may be characterized by a slender profile at a distal end thereof so as to reduce or minimize the potential for interference between the jet receiving receptacle and the workpiece 314 to be processed. The inlet feed component 324' can be maintained in close proximity to the workpiece 314 and manipulated relative to the workpiece 314 (or vice versa) in a manner that minimizes a gap between the workpiece 314 and the inlet feed component 324' despite, for example, the workpiece 314 having a complex shape or surface topography. In some instances, the fluid jet 332 may enter the inlet aperture 326' of the inlet feed component 324' within about 1.0 inch from the location at which the fluid jet 332 exits the workpiece 314 throughout the duration of a cutting operation. Additionally, the fluid jet system 310' may include a drive system that enables alignment of a central axis 323 of the inlet feed component 324' to be generally parallel to the high pressure fluid jet 332 in a deflected state during at least a portion of a workpiece processing operation, as shown in FIG. 12. In this manner, the fluid jet 332 may at times pass generally unobstructed through the inlet feed component 324', thereby reducing or minimizing wear of the inlet feed component 324'.

Figure 13B:
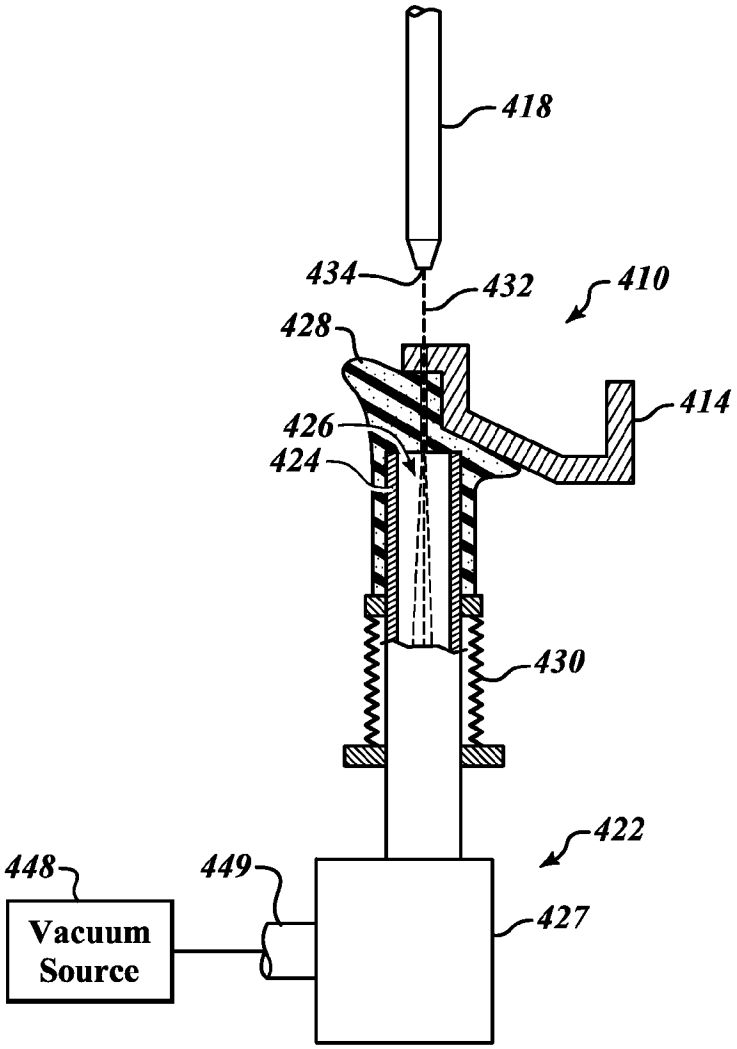
FIGS. 13A and 13B are front elevational views of a fluid jet cutting system, according to another embodiment, having a noise suppression member configured to fill a gap between a workpiece and a jet receiving receptacle.
Figure 13A:
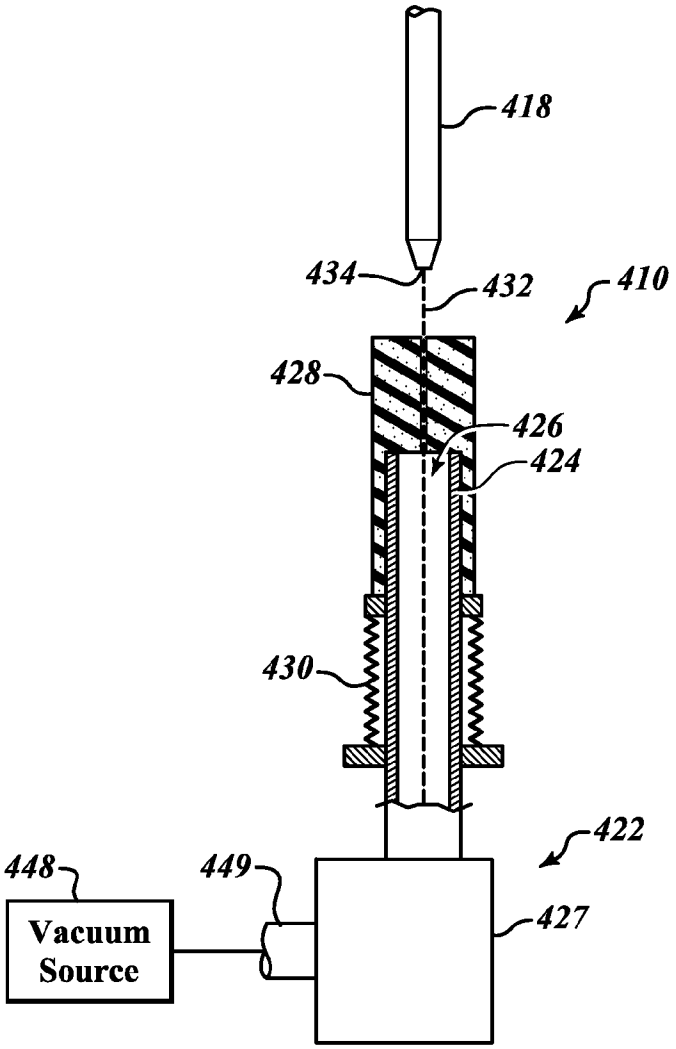

FIGS. 13A and 13B show still yet another embodiment of a fluid jet cutting system 410. The fluid jet cutting 410 includes a fluid jet cutting head 418, represented by a nozzle portion thereof, which has an orifice to generate a high pressure fluid jet 432 and a fluid jet outlet 434 from which to discharge the high pressure fluid jet 434. A jet receiving receptacle 422 is provided generally opposite the cutting head 418 to receive the high pressure fluid jet 432 after the high pressure fluid jet 432 passes through a workpiece 414 (FIG. 13B) during a processing operation. The jet receiving receptacle 422 may include an inlet feed component 424 having an inlet aperture 426 for receiving the fluid jet 432 during operation. The jet receiving receptacle 422 may further include a base 427 positioned at one end of the inlet feed component 424 and a discharge conduit 449 coupled to the base 427 to withdraw contents of the fluid jet 432 that are captured by the jet receiving receptacle 422. The discharge conduit 449 may be in fluid communication with a vacuum source 448 to assist in withdrawing the contents of the fluid jet 432 for disposal or reconditioning and reuse.

The inlet feed component 424 may be a generally slender, elongated tubular structure, such as, for example, a cylindrical tube. The inlet feed component 424 may be particularly slender and extend a length of about ten inches or more and may have a diameter equal to or less than about 1.5 inches. In some instances, the inlet feed component 424 may be an elongated tubular structure having an external surface that tapers toward the distal end to provide additional workpiece clearance in a region immediately adjacent to and downstream of the inlet aperture 426. Advantageously, the inlet feed component 424 may be characterized by a slender profile at a distal end thereof so as to reduce or minimize the potential for interference between the jet receiving receptacle 422 and the workpiece 414 to be processed. The inlet feed component 424 can be maintained in close proximity to the workpiece 414 and manipulated relative to the workpiece 414 (or vice versa) in a manner that minimizes a gap between the workpiece 414 and the inlet feed component 424 despite, for example, the workpiece 414 having a complex shapes or surface topography. In some instances, the fluid jet 432 may enter the inlet aperture 426 of the inlet feed component 424 within about 1.0 inch from the location at which the fluid jet 432 exits the workpiece 414 throughout the duration of a cutting operation.

The jet receiving receptacle 422 may further include a noise suppression member 428 coupled to the inlet feed component 424. The noise suppression member 428 may be deformable between a neutral configuration (FIG. 13A) and a compressed or deformed configuration (FIG. 13B), in which the noise suppression member 428 is able to fill or substantially fill a gap between the inlet aperture 426 of the inlet feed component 424 and the workpiece 414 being processed. The noise suppression member 428 may be coupled to the inlet feed component 424 to enable longitudinal movement of the noise suppression member 428 relative to the inlet feed component 424 as the noise suppression member 428 interacts with the workpiece 414 during operation. For example, the noise suppression member 428 may be slidably coupled to the inlet feed component 424.

The noise suppression member 428 may also be biased in an upstream direction (i.e., generally opposite the direction of the incoming fluid jet 432). For instance, a biasing device 430, such as, for example, a spring, may be positioned to bias the noise suppression member 428 in the upstream direction. In other instances, the biasing device 430 may comprise a pneumatic chamber or other mechanism for selectively biasing the noise suppression member 428 in the upstream direction. The magnitude of the reactive force applied to the workpiece 414 as the workpiece 414 is brought into contact with the noise suppression member 428 may be controlled or selected by adjusting the biasing force of the biasing device 430. For example, a relatively light bias may be provided when processing relatively delicate workpieces 414 and a relatively strong bias may be provided when processing relatively robust workpieces 414. The noise suppression member 428 may comprise a deformable or conformable material that is well-suited to adapt to a shape or surface profile of the workpiece 414. For example, the noise suppression member 428 may comprise an elastic porous material, such as solid foam, or other suitable material. The noise suppression member 428 may take a variety of shapes and forms, such as, for example, a cylindrical sleeve.

Although embodiments are shown in some of the figures in the context of processing a generic plate-like workpiece 14, 114, 214, 314, it is appreciated that the fluid jet cutting systems 10, 110, 210, 310, 410 and components described herein may be used to process a wide variety of workpieces having simple and complex shapes, including both planar and non-planar structures. Furthermore, as can be appreciated from the above descriptions, the fluid jet cutting systems 10, 110, 210, 310, 410 described herein are specifically adapted to generate a high-pressure fluid jet and capture the same in a particularly environmentally friendly manner. The environment of the fluid jet cutting systems 10, 110, 210, 310, 410 may be relatively quiet and free from water hazards and other conditions that are typically prevalent in conventional fluid jet cutting environments.

Moreover, aspects of the various embodiments described above can be combined to provide further embodiments. For example, aspects of the noise suppression member 428 and biasing device 430 shown in FIGS. 13A and 13B may be included in or applied to the fluid jet cutting systems 10, 110, 210, 310 and related methods described with respect to FIGS. 1 through 12. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A fluid jet cutting system, comprising:

a multiaxial industrial robot having an end effector to grip a workpiece to be processed, the multiaxial industrial robot configured to selectively move the workpiece within a working envelope defined by a range of motion of the multiaxial industrial robot;

a tank positioned within the working envelope of the multiaxial industrial robot to enable the workpiece to be submerged under fluid within the tank during a workpiece processing operation; and at least one fluid jet cutting head suspended with a portion thereof located above an open end of the tank, the at least one fluid jet cutting head having an orifice to generate a high pressure fluid jet and a fluid jet outlet from which to discharge the high pressure fluid jet, and the cutting head being located relative to the tank such that, during the workpiece processing operation, the high pressure fluid jet discharges from the fluid jet outlet beneath an upper surface of the fluid within the tank, cuts through the workpiece, and dissipates within a region of the fluid in the tank located adjacent a side of the workpiece opposite the cutting head.

2. The fluid jet cutting system of claim 1 wherein the at least one fluid jet cutting head includes a central axis along which the fluid jet is discharged, and wherein the central axis of the at least one fluid jet cutting head is aligned vertically and oriented such that the fluid jet is discharged downward from the fluid jet outlet during the workpiece processing operation.

3. The fluid jet cutting system of claim 1 wherein the at least one fluid jet cutting head includes a central axis along which the fluid jet is discharged, and wherein the central axis of the at least one fluid jet cutting head is inclined relative to a direction normal to the upper surface of the fluid within the tank.

4. The fluid jet cutting system of claim 1, further comprising:

an inspection station located outside of the tank within the working envelope defined by the range of motion of the multiaxial industrial robot to enable inspection of the workpiece prior to or after submersion in the tank.

5. The fluid jet cutting system of claim 1 wherein the at least one fluid jet cutting head is spaced away from sidewalls of the tank to permit the multiaxial industrial robot to maneuver the workpiece beneath the discharged fluid jet without obstruction from the tank.

6. A fluid jet cutting system, comprising:

a multiaxial industrial robot having an end effector to grip a workpiece to be processed, the multiaxial industrial robot configured to selectively move the workpiece within a working envelope defined by a range of motion of the multiaxial industrial robot;

a tank positioned within the working envelope of the multiaxial industrial robot to enable the workpiece to be submerged under fluid within the tank during a workpiece processing operation; and a first fluid jet cutting head and a second fluid jet cutting head each having an orifice to generate a high pressure fluid jet, a fluid jet outlet from which to discharge the high pressure fluid jet, and a central axis, the central axis of the first fluid jet cutting head being aligned perpendicularly with respect to the central axis of the second fluid jet cutting head, and wherein at least one of the first fluid jet cutting head and the second fluid jet cutting head is located relative to the tank such that, during the workpiece processing operation, the high pressure fluid jet discharges from the fluid jet outlet of the fluid jet cutting head beneath an upper surface of the fluid within the tank, cuts through the workpiece, and dissipates within a region of the fluid in the tank located adjacent a side of the workpiece opposite the fluid jet cutting head.

7. The fluid jet cutting system of claim 6 wherein the first fluid jet cutting head is suspended with a portion thereof located above an open end of the tank.

8. The fluid jet cutting system of claim 7 wherein the first fluid jet cutting head is spaced away from sidewalls of the tank to permit the multiaxial industrial robot to maneuver the workpiece beneath the discharged fluid jet of the first fluid jet cutting head without obstruction from the tank.

9. The fluid jet cutting system of claim 6 wherein the second fluid jet cutting head is attached to a sidewall of the tank and extends through the sidewall of the tank.

10. The fluid jet cutting system of claim 9 wherein the second fluid jet cutting head is movably attached to the sidewall of the tank to enable angular adjustment of the fluid jet cutting head relative to the tank.

11. The fluid jet cutting system of claim 6, further comprising:

an inspection station located outside of the tank within the working envelope defined by the range of motion of the multiaxial industrial robot to enable inspection of the workpiece prior to or after submersion in the tank.

* * * * *